US008485493B2

(12) United States Patent
Wells et al.

(10) Patent No.: US 8,485,493 B2
(45) Date of Patent: Jul. 16, 2013

(54) CONCRETE COLUMN FORMING ASSEMBLY

(75) Inventors: Donald Wells, Colchester, VT (US); Karen Wells, Colchester, VT (US)

(73) Assignee: Soundfootings, LLC, Colchester, VT (US)

( * ) Notice: Subject to any disclaimer, the term of this patent is extended or adjusted under 35 U.S.C. 154(b) by 884 days.

(21) Appl. No.: 11/859,179

(22) Filed: Sep. 21, 2007

(65) Prior Publication Data

US 2008/0072510 A1 Mar. 27, 2008

Related U.S. Application Data

(60) Provisional application No. 60/846,325, filed on Sep. 21, 2006.

(51) Int. Cl.
*E04G 13/02* (2006.01)

(52) U.S. Cl.
USPC ..... 249/48

(58) Field of Classification Search
USPC ..... 249/13, 18, 48, 49, 51, 119; 52/292, 52/294, 295, 296, 297, 298, 251, 745.17; 220/4.28, 682, 691
See application file for complete search history.

(56) References Cited

U.S. PATENT DOCUMENTS

| | | | | |
|---|---|---|---|---|
| 723,064 | A | 3/1903 | Stoner | |
| 783,901 | A | 2/1905 | Sheldon | |
| 785,356 | A | 3/1905 | Gow et al. | |
| 822,814 | A | 6/1906 | Baker | |
| 975,135 | A * | 11/1910 | Kelsey | 249/143 |
| 986,957 | A | 3/1911 | Wallin | |
| 1,062,718 | A | 5/1913 | Layne | |
| 1,170,049 | A * | 2/1916 | Cunningham | 249/49 |
| 1,211,133 | A | 1/1917 | Geiger | |
| 1,296,995 | A | 3/1919 | Miller | |
| 1,428,953 | A | 9/1922 | Garlinghouse | |
| 1,601,379 | A * | 9/1926 | Swan | 249/51 |
| 1,947,413 | A | 2/1934 | Hay | |
| 2,369,965 | A * | 2/1945 | Harris | 126/151 |
| 2,448,883 | A | 9/1948 | Hall | |
| 2,604,058 | A * | 7/1952 | Orange | 249/168 |
| 2,831,231 | A * | 4/1958 | Toensing | 249/48 |

(Continued)

FOREIGN PATENT DOCUMENTS

| | | |
|---|---|---|
| DE | 150359 | 8/1981 |
| DE | 3215579 A1 | 10/1983 |

(Continued)

*Primary Examiner* — Janet M Wilkens
*Assistant Examiner* — Timothy M Ayres
(74) *Attorney, Agent, or Firm* — Pierce Atwood LLP; Joseph M. Maraia

(57) ABSTRACT

Methods and apparatus providing a column forming assembly formable from multiple column forming sub-assemblies that are stackable providing a compact storage or transport configuration. A column forming structure is formed from multiple elongated wall sections configured for interlocking engagement with each other to form a hollow, open ended structure adapted to accept a settable substance, such as concrete or plaster. The multiple elongated wall sections are stackable and can be stored to shipped to a job site in a condensed or nested configuration. The nested configuration reduces empty or hollow spaces provided by assembled forms. In some embodiments, the forms can be disassembled after use for transport from the jobsite, storage, and later reuse. The column forming assembly can be combined with one or more column-end forms and with thin-walled column forming inserts.

15 Claims, 25 Drawing Sheets

U.S. PATENT DOCUMENTS

| | | | | | |
|---|---|---|---|---|---|
| 3,291,437 | A | * | 12/1966 | Bowden et al. | 249/48 |
| 3,301,926 | A | | 1/1967 | Reiland | |
| 3,435,575 | A | * | 4/1969 | Pottiez | 312/108 |
| 3,488,027 | A | | 1/1970 | Evans | |
| 3,588,027 | A | * | 6/1971 | Bowden | 249/48 |
| 3,632,078 | A | | 1/1972 | Dashew | |
| 3,682,434 | A | * | 8/1972 | Boenig | 249/48 |
| 4,023,374 | A | * | 5/1977 | Colbert et al. | 405/216 |
| 4,047,356 | A | | 9/1977 | De Pirro | |
| 4,623,025 | A | | 11/1986 | Verstraeten | |
| 4,648,220 | A | | 3/1987 | Gebelius | |
| 4,673,157 | A | | 6/1987 | Wells | |
| 4,767,241 | A | | 8/1988 | Wells | |
| 4,830,543 | A | | 5/1989 | Joubert | |
| 5,255,888 | A | * | 10/1993 | Workman | 249/48 |
| 5,271,203 | A | | 12/1993 | Nagle | |
| 5,571,229 | A | * | 11/1996 | Fitzsimmons et al. | 473/481 |
| 5,597,084 | A | * | 1/1997 | Parasin | 220/4.28 |
| 5,785,459 | A | | 7/1998 | Swinimer | |
| 5,800,727 | A | | 9/1998 | Croghan | |
| 5,890,333 | A | | 4/1999 | Boroviak | |
| 6,318,700 | B1 | | 11/2001 | Cliff | |
| 6,543,742 | B2 | * | 4/2003 | Wells | 249/51 |
| 2002/0179808 | A1 | * | 12/2002 | Salinas | 249/48 |

FOREIGN PATENT DOCUMENTS

| | | |
|---|---|---|
| GB | 181424 | 6/1922 |
| JP | 130634 | 8/1982 |
| JP | 0029917 | 2/1983 |
| NL | 3841 | 6/1919 |

* cited by examiner

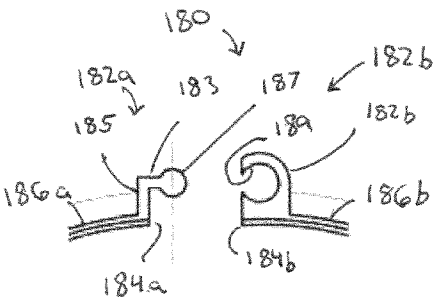
FIG. 4A(i)
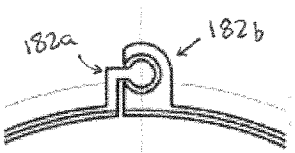
FIG. 4A(ii)
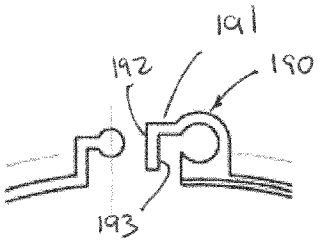
FIG. 4B(i)
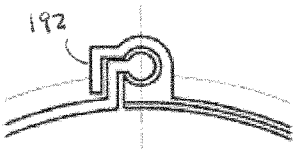
FIG. 4B(ii)
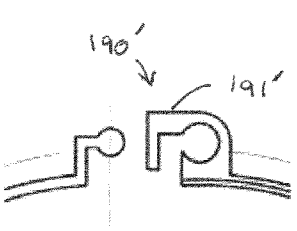
FIG. 4C(i)
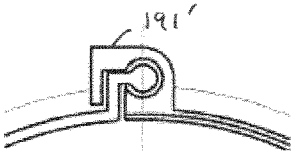
FIG. 4C(ii)
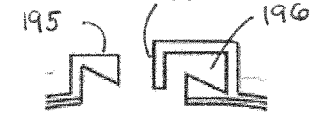
FIG. 4D(i)
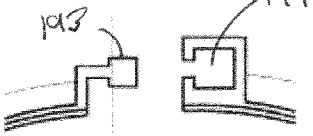
FIG. 4D(ii)
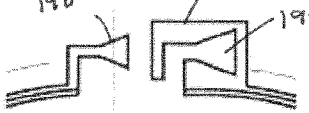
FIG. 4E(i)
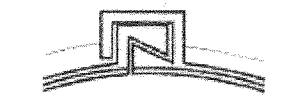
FIG. 4E(ii)
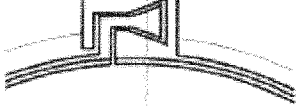
FIG. 4F(i)
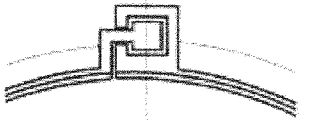
FIG. 4F(ii)

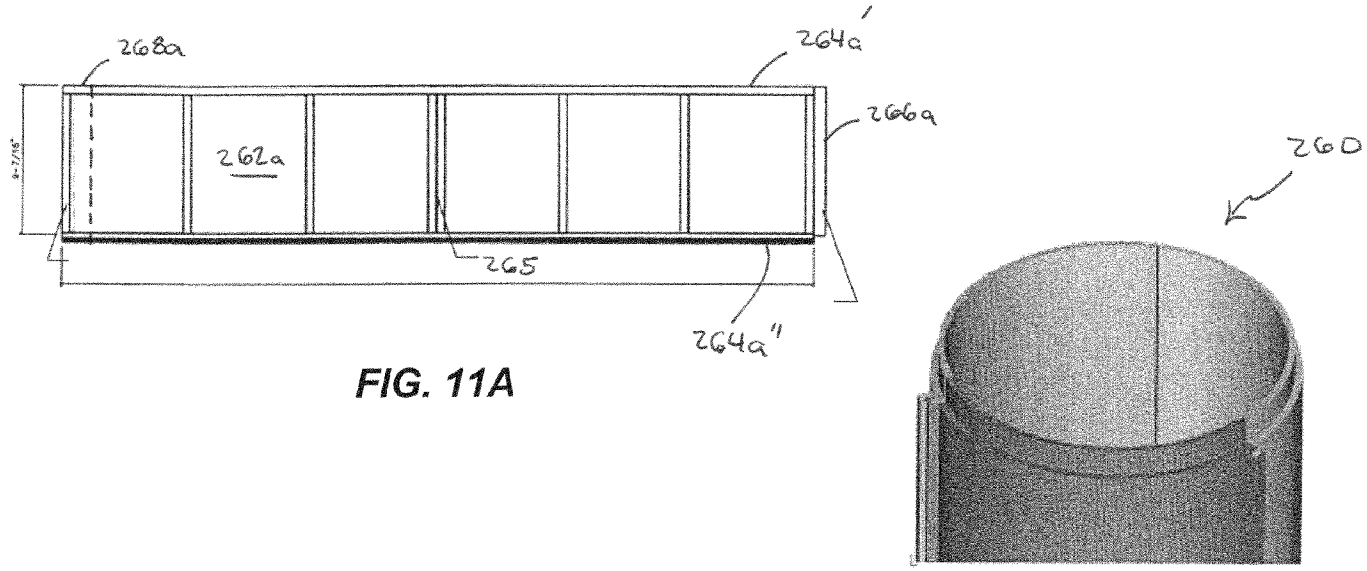
FIG. 11A
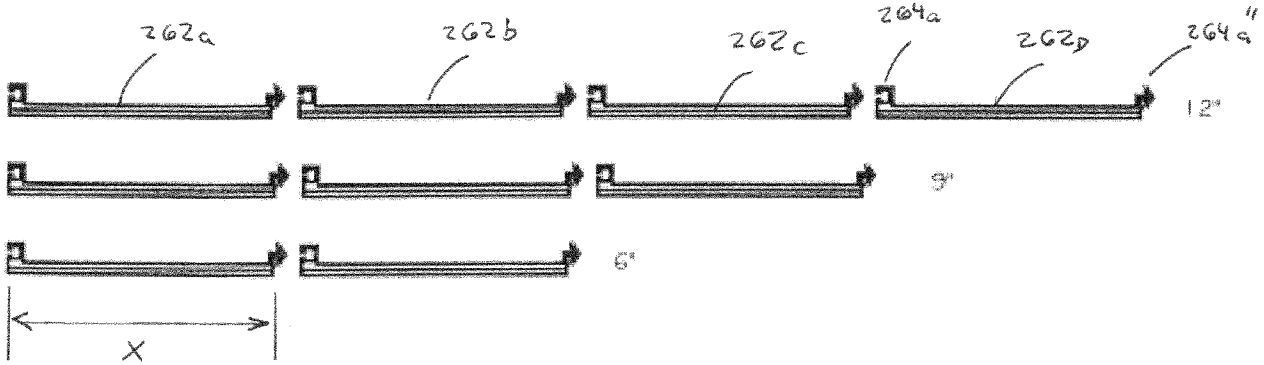
FIG. 11C
FIG. 11B

CONCRETE COLUMN FORMING ASSEMBLY

CROSS-REFERENCE TO RELATED PATENT APPLICATIONS

The present application claims priority to U.S. Provisional Patent Application Ser. No. 60/846,325, filed on Sep. 21, 2006, which application is incorporated herein by reference in its entirety.

FIELD OF THE INVENTION

The present disclosure relates to forms for molding settable materials such as concrete, polymer concrete, or the like and, in particular, to forms for molding concrete column forms and wherein the forms are made of stackable, plastic sections. The present disclosure also relates to form inserts for molding shaped concrete columns and forms for molding concrete footings or capitals for structural pillars.

BACKGROUND OF THE INVENTION

In order to construct concrete columns, piers and footings, it is generally necessary to utilize a concrete form. The form act as a mold for pouring concrete to provide a desired size and shape. Among available forms are spirally-wrapped fiber forms, steel sectional forms and fiberglass forms. Fiber forms are generally single-piece cylindrical forms of a select diameter. The form can be cut to length on a job site, erected, braced, and stripped quickly and easily. As such, these forms are not reusable. Also, the fiber forms are less desirable when used in wet areas, and also leave helical seams on the finished concrete column.

Steel forms generally comprise half round sections bolted into units. Each section comprises a semi-cylindrical wall framed with flange angles die cut and punched for flush butt joints. Vertical and horizontal seams are connected with bolts. A plurality of similar or different length sections can be stacked together according to the necessary column height. Some of the problems with steel sectional forms include heavy weight, expensive production, and the possibility of rusting of the steel. Also, grout leakage can occur where the flanges abut, which degrades the appearance of the finished concrete column.

Fiberglass forms have also been used in half-round sections, as with steel form sections. However, such fiberglass sections lack uniformity in wall and flange thickness and do not stack as well. Further, fiberglass flanges require steel backing where bolts are used for securing sections together. One known form of such fiberglass forms utilizes tongue and groove vertical flanges to minimize vertical seams in the concrete columns. However, problems still remain owing to possible horizontal seams.

SUMMARY OF THE INVENTION

The present disclosure provides exemplary embodiments of stackable plastic column forms, wherein the column forms are provided in multiple shapes for overcoming one or more of the problems discussed above in a novel and simple manner. The present disclosure also provides exemplary embodiments of connecting flanges for column forms.

Among other aspects and benefits, column forms according to the present disclosure provide concrete columns with smooth continuous surfaces, are light weight and water resistant, are easy to store, ship, and assemble, are reusable, can be used with fiber or metal forms.

In one aspect, the invention relates to a kit for forming a concrete column-forming tube including multiple elongated wall sections, each having an interior surface, a top edge, a bottom edge, and opposite side edges and a pair of interconnecting flanges. Each of the interconnecting flanges is fixedly attached to a respective one of the opposite side edges. Each of the pair of interconnecting flanges is adapted for interlocking engagement with a respective one of a pair of interconnecting flanges of an adjacent wall section. The multiple wall sections are joinable together along adjacent side edges in interlocking engagement to form a closed side wall extending vertically between two opposing ends of the column-forming tube, the closed side wall defining a central lumen.

In another aspect, the invention relates to a process for constructing a concrete column-forming tube. Multiple wall section are provided, with each wall section having a pair of interlocking flanges. Each interlocking flange of the pair is fixedly attached to a respective opposite side edge of the wall section. The multiple wall sections are joined together to form a closed sidewall extending vertically between two opposing ends of the column-forming tube. In so doing, opposite side edges of adjacent wall sections are aligned and at least one of the pair of interlocking flanges of one wall section engages with a corresponding one of the pair of interlocking flanges of the adjacent wall section. A substantially fluid tight joint is formed by the interlocking engagement between the adjacent wall sections.

In another aspect, the invention includes a form for molding a footing of a settable structural material at an end of a form for molding a pillar, the end of the form having an inner surface having along a longitudinal axis and having a cross sectional shape of a diameter including a hollow base extending along a longitudinal axis and having a bottom, a shoulder defining an open top of the base, and a side wall extending from the bottom to the shoulder along the longitudinal axis; and a hollow sleeve extending along the longitudinal axis from the shoulder and providing fluid communication with the open top of the base, wherein the hollow sleeve includes a plurality sleevelets stacked along the longitudinal axis, at least one sleevelet of the plurality of sleevelets comprising a cross sectional shape and at least another sleevelet of the plurality of sleevelets comprising a different cross sectional shape.

In yet another aspect, the invention includes a column form insert includes multiple elongated, thin-walled column inserts having at least one elongated vertical wall section. The inserts are dimensioned to fit within a column form and include at least one reinforcing rib attached to an outside surface of the elongated vertical wall section. The reinforcing rib is dimensioned to fill a void between an outer surface of the elongated vertical wall section and an interior surface of the column form within a plane of the rib. When inserted, the elongated thin-walled column inserts define an interior lumen to accept a poured settable material.

Further features and advantages of the present disclosure will readily be apparent from the specification and from the drawings.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4A(i) and FIG. 4A(ii) show a partial end view of one embodiment of interconnecting flanges, in which the interconnecting flanges are respectively shown unmated and mated.

FIG. 4B(i) and FIG. 4B(ii) show a partial end view of another embodiment of interconnecting flanges, in which the interconnecting flanges are respectively shown unmated and mated.

FIG. 4C(i) and FIG. 4C(ii) show a partial end view of another embodiment of interconnecting flanges, in which the interconnecting flanges are respectively shown unmated and mated.

FIG. 4D(i) and FIG. 4D(ii) show a partial end view of another embodiment of interconnecting flanges, in which the interconnecting flanges are respectively shown unmated and mated.

FIG. 4E(i) and FIG. 4E(ii) show a partial end view of another embodiment of interconnecting flanges, in which the interconnecting flanges are respectively shown unmated and mated.

FIG. 4F(i) and FIG. 4F(ii) show a partial end view of yet another embodiment of interconnecting flanges, in which the interconnecting flanges are respectively shown unmated and mated.

FIG. 11A shows a plan view of a further exemplary embodiment of a concrete column form section for forming a concrete column form in accordance with the present invention.

FIG. 11B shows an end view of the exemplary embodiment shown in FIG. 11A wherein the form sections are shown disassembled for various sized columns.

FIG. 11C shows a top perspective view of a top portion of a concrete column form constructed using the sections of FIG. 11A and FIG. 11B.

DETAILED DESCRIPTION OF THE PREFERRED EMBODIMENTS

A description of preferred embodiments of the invention follows.

A hollow column forming structure kit includes multiple elongated wall sections configured for interlocking engagement with each other to form a hollow, open ended structure adapted to accept a settable substance, such as concrete or plaster. The multiple elongated wall sections are stackable and can be stored to shipped to a job site in a condensed or nested configuration. The nested configuration is primarily achieved by avoiding storage or transport with empty hollow space provided by the assembled forms. In some embodiments, the forms can be disassembled after use for transport from the jobsite, storage, and later reuse.

Figure 1:
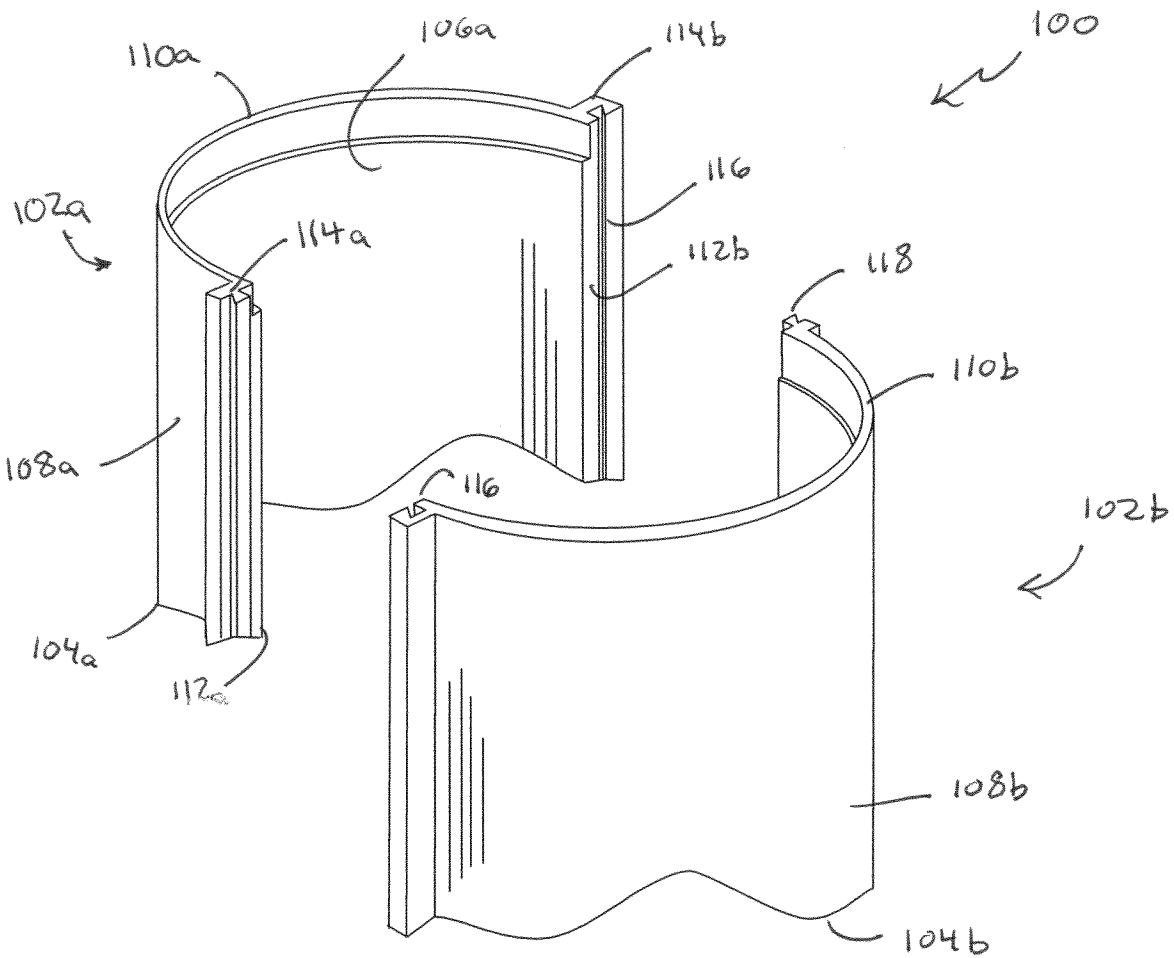
FIG. 1 shows an exploded top perspective view of a top portion of one embodiment of a concrete column forming assembly constructed in according to principles of the present invention.

An exploded top perspective view is shown in FIG. 1 of a top portion of an exemplary embodiment of a concrete column-forming tube kit for constructing a form assembly 100 according to principles of the present invention. The kit for constructing the form assembly 100 includes two longitudinal sections 102*a*, 102*b* (generally 102). In the exemplary embodiment, each longitudinal section 102 is an elongated wall, semi-cylindrical in cross section. The two longitudinal sections 102 when joined together along opposite edges form a column-forming tube into which a material, such as concrete, can be poured to form an elongated cylindrical column.

Each longitudinal section 102 includes a respective elongated side wall 104*a*, 104*b* (generally 104) extending between opposing ends of the forming tube. Each of the elongated side walls 104 defines an inside surface 106*a*, 106*b* (generally 106) and an outside surface 108*a*, 108*b* (generally 108). The inside surface 106 forms a supporting surface for material poured into the formed tube. The inside surface 106 can be smooth or sculpted according to the desired outer surface of the column formed thereby. Each side wall 104 respectively includes a top edge 110*a*, 110*b*, a bottom edge (not shown), and opposite side edges 112*a*, 112*b* (generally 112). For cylindrical columns, pairs of side edges 112 of each side wall 104 are parallel.

A cylindrical concrete column-forming tube 100 is assembled by aligning the two semi-cylindrical sections 102 about a common longitudinal axis, such that the inside surfaces 106 of the longitudinal sections 102 face each other. Contact is established between the aligned sections 102 along opposing side edges 112. Namely, a right-hand side edge 112*a* of a first longitudinal section 102*a* contacts a left-hand side edge 112*b* of a second longitudinal section 102*b*. For a two-section form, as shown, the left-hand side edge 112*b* of the first section 102*a* contacts a right-hand side edge 112*a* of the second section 102*b*.

The longitudinal column-forming sections 102 are securely fastened together such that concrete poured into an open end of the form 100 is retained therein. To facilitate fastening, each of the sections 102 includes at least one half of an interlocking connector pair. For example, each of the sections 102 includes a pair of flanges 114*a*, 114*b* (generally 114) along opposite side edge 112. Each flange 114 is longitudinally aligned with its respective side edge 112 and extends radially away from the outside surface 108. The flanges 114 can include one or more fastening elements 116 adapted to securely engage complementary fastening elements 118 of an opposing section 102. Preferably, interlocking engagement of the one or more fastening elements 116, 118 provides sufficient retaining force to keep the sections 102 together under pressures resulting from concrete housed therein, without the need for additional retaining means, such as belts, chains, clamps, or other removable fasteners, such as screws, bolts, and pins.

In some applications, the longitudinal sections 102 remain in place indefinitely after the column is formed. For example, when used to pour footings the form assembly 100 can remain in place after concrete has been poured into it and cured. The form assembly 100 can be covered by backfill. In such applications, the form can be made from an environmentally friendly material, such as a biodegradable material. Such materials include cellulose materials. Other suitable biodegradable materials can include plastarch materials and polylactides.

In some embodiments, the forms are made at least partially from recycled material, such as recycled polypropylene. Alternative or in addition, the forms are treated to provide UV protection, allowing the forms to be safely stored outside for extended periods of time. Such UV protection can be achieved using UV blockers, UV absorbers, or a combination of UV blockers and UV absorbers. In some embodiments, the UV protection is applied as a coating to the form. Alternatively or in addition, the UV protection is impregnated into the material of the form itself.

In other applications, the longitudinal sections 102 of the form assembly 100 can be separated from each other after the material poured therein has cured, exposing a formed column. The longitudinal sections can be formed from any of a variety of suitable rigid, semi-rigid, and even flexible materials including plastics, metals, alloys, wood-based materials. Preferably, the material or materials chosen are substantially non-elastic, such that a volume formed within the form assembly 100 remains substantially constant during use. In some embodiments, the longitudinal sections 102 are formed using an injection molding process, in which a thermoplastic material is injected into a mold. Once set, the material retains its form.

In some embodiments, the sections 102 are removable in a destructive manner, such as by cutting, tearing, or melting. Preferably, the sections 102 are removable in a non-destructive manner, such that they can be reused. For applications in which the sections 102 are to be removed, they may be pretreated with a compound to facilitate their removal. For example, the interior surface of each section 102 can be pretreated by a lubricant before a material is poured into the form.

Figure 2:
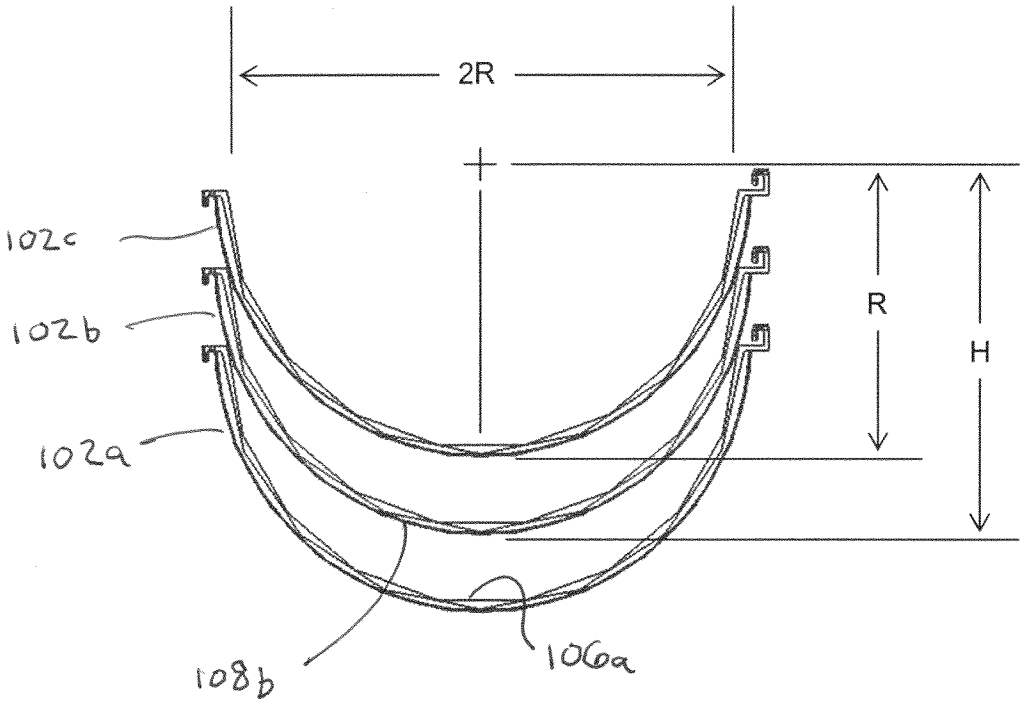
FIG. 2 shows an end elevation view of exemplary disassembled concrete column forming assembly components efficiently stacked for storage or transport.

At least one advantage of having a form assembly 100 including multiple longitudinal sections 102 is that they can be arranged or nested to take advantage of interior space during storage shipment. Referring to FIG. 2 an end elevation view of several elongated sections 102*a*, 102*b*, 102*c* is shown arranged in a stack, or nested configuration. As illustrated, more than one longitudinal sections 102 are aligned longitudinally, with an outside surface 108*b* of one section 102*b* facing an interior surface 106*a* of another section 102*a*. Such a nested configuration particularly well suited for storage and shipping. For the semi-circular column sections 102, two sections of radius R stack to a height H, with the height H being much less than twice the radius (i.e., 2R). The space savings is substantial compared to assembled columns for which the height of a pair of adjacent sections would be 2R. Even when the sections 102 are substantially identical (e.g., identical semi-cylindrical sections), they area able to stack in a reduced volume. In the exemplary embodiment, two of the semi-cylindrical sections 102, each having a respective height R, stack with a height H that is substantially less than twice the height of an individual section (i.e., H<2R). Even greater space savings can be realized for forms that disassemble into more than two circumferential sections. For example, a three-section embodiment in which each section subtends 120°, the stacked height would be less as the individual sections would be able to stack together more closely.

Figure 3D:
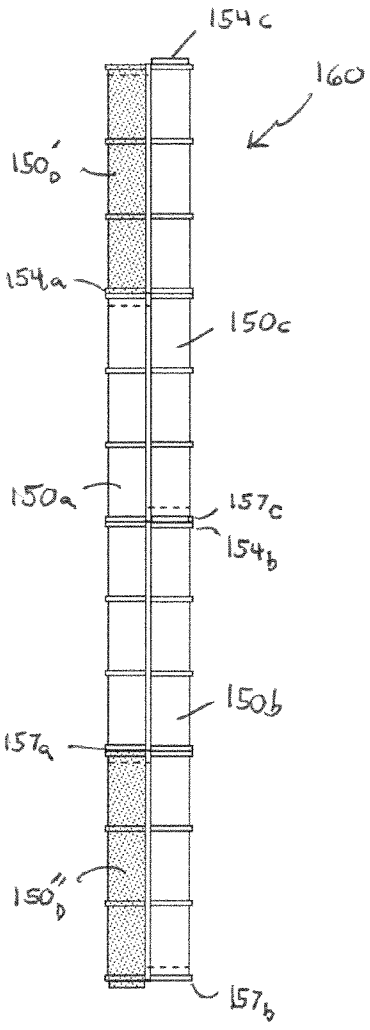
FIG. 3D shows a side elevation view of an assembled concrete column forming assembly utilizing an exemplary embodiment of two sections and halved sections according to the present invention vertically stacked together in a stagger joint configuration.
Figure 3C:
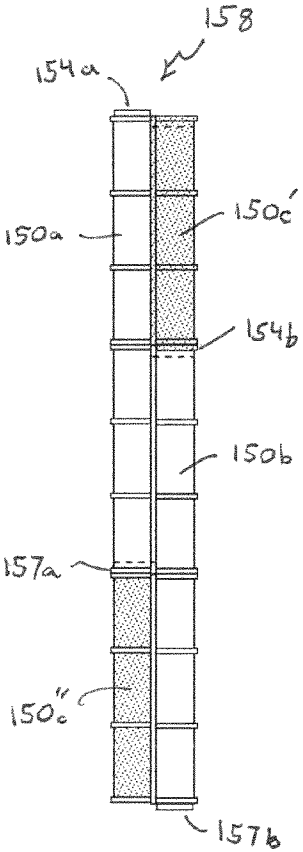
FIG. 3C shows a side elevation view of an assembled concrete column forming assembly utilizing an exemplary embodiment of two sections and halved sections according to the present invention vertically stacked together in a stagger joint configuration.
Figure 3B:
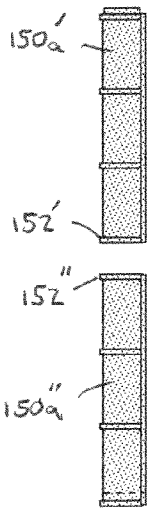
FIG. 3B shows a side elevation view of one half of a two-section concrete column forming assembly halved into sub-sections.
Figure 3A:
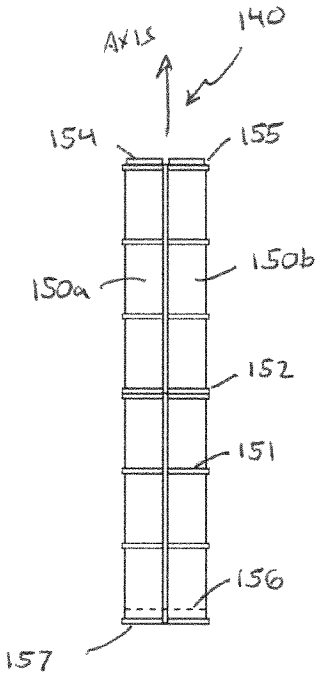
FIG. 3A shows a side elevation view of an assembled concrete column forming assembly utilizing an exemplary embodiment of two sections according to the present invention.

Referring to FIG. 3A shows a side elevation view of an assembled concrete column-forming assembly 140. The form assembly 140 includes two half sections 150*a*, 150*b* (generally 150) that when joined together as shown form a complete form assembly 140. Thus, the height of each half section 150 extends for the entire height of the form assembly. In some embodiments, the column sections 150 include one or more circumferential reinforcing ribs 151. These ribs 151 can be formed by providing a thicker wall for a limited axial dimension and extending the full lateral extent of the section. In some embodiments, the half sections include features that allow more than one pair of half sections 150 to be stacked end on, forming an elongated form assembly. For example, an interior circumferential lip 155 is provided at a top end 154 of each half section 150. A corresponding exterior circumferential lip 156 is provided at a bottom end 157 of each half section. The interior and exterior lips 155, 156 are dimensioned to overlap within a tolerance, allowing pairs of assembled half sections 150 to be joined together along a common axis. A top end 156 of one pair of joined half sections 150 is fitted into a bottom end 157 of another axially aligned pair of joined half sections 150. The combination provides an overall form assembly having a length greater than the individual sections 150. The end joining can be continued, adding additional pairs of sections 150 to obtain a form assembly of a desired height.

In some embodiments, one or more of the column forming sections 150 can be shortened to obtain a form assembly having a tailored height. For example, each column-forming section 150 of a joined pair can be axially shortened by cutting off a desired length of each section 150. In some embodiments, one or more circumferential guides, such as central rib 152, can be provided to identify locations at which each of the elongated sections 150 can be shortened. A side elevation view is shown in FIG. 3B illustrating one section 150*a* after being severed along its central rib 152. As a result, the concrete column forming assembly 150 is halved into to sub-sections 150*a*', 150*a*". Each sub-section 150*a*', 150*a*" includes a respective portion of the severed rib 152', 152".

A side elevation view of an alternative assembled concrete column-forming assembly is shown in FIG. 3C with a vertically stacked staggered joint configuration. The exemplary column-forming assembly 158 includes two equal length half sections 150*a*, 150*b* each aligned with the other about a common central axis, with one section 150*a* being axially displaced from the other. As a consequence of the staggering, a top edge 154*a* of the first section 150*a* extends axially beyond a top edge 154*b* of the second section. Being of substantially equal length, a bottom edge 157*b* of the second section 150*b* extends axially beyond a bottom edge 157*a* of the first section 150*a*. To complete the form assembly 158, a first smaller sections 150*c*' is attached to the first section 150*a* at a top end and a second smaller section 150*c*" is attached to the second section 150*b* at a bottom end of the form assembly 158. The smaller sections 150*c*', 150*c*" can be formed by cutting in half a third section 150*c*, similar to either of the first and second sections 150*a*, 150*b* as described above. If all sections 150*a*, 150*b*, 150*c* are of equal length L, the overall length of the staggered assembly will be 1.5 L. The overlap can be varied to obtain any desired length between L and 2L, with suitable smaller sections added to complete the form assembly 158.

In addition to increasing the overall length, the staggered elongated sections provided additional rigidity along the length of the form assembly 158. In some embodiments, the first and second sections 150*a*, 150*b* each have their top lip portion extending in the same direction. Alternatively, the first and second sections 150*a*, 150*b* can be aligned in opposite sense, each having its top lip portion extending in an opposite direction, as shown.

In some embodiments, the staggered configuration can be extended to lengths equal to or greater than 2L, by adding additional segments to the arrangement of FIG. 3C to form even longer form assemblies. A side elevation view of assembled concrete column forming assembly 160 utilizing multiple staggered sections is shown in FIG. 3D. In the exemplary form assembly 160, two sections 150*a*, 150*b* are connected in a staggered arrangement as described above. To this arrangement, a third full section 150*c* is added to a top end of the arrangement, with its top end 154*c* extending axially beyond the top end of the first section 154*a*. A fourth section 150*d* is cut in half and respective ones of the half sections 150*d*', 150*d*" are attached at the top and bottom ends of the first section 150*a* to form a complete cylindrical column-forming assembly 160 of a length 2L. Once again, the orientation of each of the sections can be varied, such that full and partial sections 150*a*, 150*d*', 150*d*" along one side of the vertical form assembly 160 are oriented in one direction; whereas, sections 150*b*, 150*c* along another side of the vertical form assembly 160 can be oriented in the same or a different direction.

Referring to FIG. 4A(i) and FIG. 4A(ii), a partial end view of one embodiment of a pair of interconnecting flanges is shown, in which the interconnecting flanges are respectively shown unmated and mated. A longitudinal edge 184*a* of a first elongated section 186*a* includes a first interconnecting fastener element 182*a*. The first fastener element 182 includes an extension arm 185 extending radially outward from the longitudinal edge 184*a*. The outermost end of the extension arm 185 includes a remote angled portion 183 directed tangentially toward the mating interconnecting flange. A circular cylindrical element 187, viewed in profile, is disposed at an outer end of the remote angled portion 183, forming an interlocking pin adapted for insertion into a complementary socket.

A longitudinal edge 184*b* of a second elongated section 186*b* includes a second interconnecting fastener element 182*b*. The first fastener element 182*b* includes an extension arm 181 extending radially outward from the longitudinal edge 184*b*. The extension arm 181 includes a concave cavity 189 open along end directed toward the cylindrical pin 187 of an adjacent longitudinal section 186*a*. Interlocking engagement can be accomplished by aligning a central axis of the cylindrical pin 187 with a central axis of the concave cavity 189, the pin 187 and concave cavity 189 being axially displaced. After being so aligned, the first elongated section 186*a* is translated axially with respect to the second elongated section 186*b*, such that the cylindrical pin 187 slides into interlocking engagement with an open end of the concave cavity 189, the open slot of the cavity 189 accommodating the remote angled portion 183. Once the interlocking fasteners are interlocked, they provide a retaining force adapted to keep the longitudinal edges 184*a*, 184*b* of adjacent elongated sections 186*a*, 186*b* engaged with respect to each other. As illustrated, each of the interlocking connector elements 182*a*, 182*b* can be integrally formed with its respective elongated section 186*a*, 186*b*. The retaining force of such an arrangement depends at least in part upon the strength and resiliency of the material used and on the relative thicknesses of the different components.

Referring to FIG. 4B(i) and FIG. 4B(ii), a partial end view of an alternative embodiment of the interconnecting flanges of FIGS. 4A(i) and 4A(ii) is shown, in which the interconnecting flanges are respectively shown unmated and mated. In this embodiment, the second interlocking fastening element 182*b* includes a retaining extension 190 provided along an outer side of the open slot of the cavity 189. The retaining extension 190 includes a first member 191 extending tangentially toward a mating interlocking fastening element terminating in an angled extension 192 directed radially inward. An inner surface 193 of the angled extension 192 forms a bearing surface 193 facing an outer surface of a radially extending arm 185 of an interlocked fastening element 182*a* when engaged therewith. The bearing surface 193 of the retaining extension 190 contributes to the retaining force by acting to retain the cylindrical pin 187 within the concave cavity 189 under greater loading forces.

Referring to FIG. 4C(i) and FIG. 4C(ii), a partial end view of yet another embodiment of a pair of interconnecting flanges similar to those shown in FIGS. 4B(i) and 4B(ii) shown, in which the interconnecting flanges are respectively shown unmated and mated. In this embodiment, the first member 191' of the retaining extension 190' includes a reinforced member. Reinforcement can be provided by forming a thicker first member 191' as shown.

Referring to FIG. 4D(i) and FIG. 4D(ii), a partial end view of another embodiment of a pair of interconnecting flanges is shown, in which the interconnecting flanges are respectively shown unmated and mated. This embodiment is similar to the bulbous-concave combination shown in FIGS. 4A(i) and 4A(ii), except the pin 193 and its receiving cavity 194 are each square in end profile.

Referring to FIG. 4E(i) and FIG. 4E(ii), a partial end view of another embodiment of a pair of interconnecting flanges is shown, in which the interconnecting flanges are respectively shown unmated and mated. This embodiment is similar to the bulbous-concave combination shown in FIGS. 4A(i) and 4A(ii), except the pin 195 and its receiving cavity 196 are each wedge-shaped in end profile. In this embodiment, the cavity includes a retaining member 197, similar to the retaining member 190 shown in FIGS. 4B(i) and 4B(ii).

Referring to FIG. 4F(i) and FIG. 4F(ii), a partial end view of yet another embodiment of a pair of interconnecting flanges similar to those shown in FIGS. 4E(i) and 4E(ii), in which the interconnecting flanges are respectively shown unmated and mated. In this embodiment, the pin 198 and its receiving cavity 199 are each dovetail shaped in end profile. In this embodiment, the cavity includes a retaining member 200, similar to the retaining member 190 shown in FIGS. 4B(i) and 4B(ii). Other interlocking arrangements are possible using different shapes in end profile. These shapes may include polygons, arcs and combinations of polygons and arcs. In some embodiments, the different shapes are used to control which elongated sections are joined together, the joining sections having complementary shapes (e.g., a dovetail pin with a dovetail socket and not with a square socket or a circle socket).

Figures 5A, 5B:
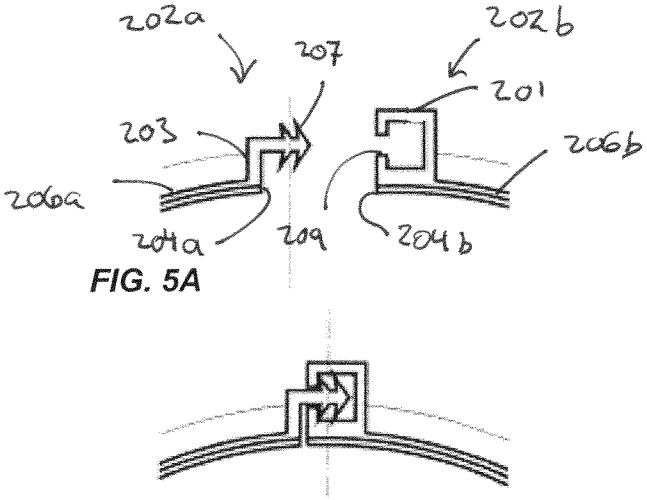
FIG. 5A and FIG. 5B show a partial end view of a further exemplary embodiment of interconnecting flanges, in which the interconnecting flanges are respectively shown unmated and mated.

Referring to FIG. 5A and FIG. 5B, a partial end view of a further exemplary embodiment of interconnecting flanges is shown, in which the interconnecting flanges are respectively shown unmated and mated. A first fastener element 202*a* includes an offset extension arm 203 extending radially outward from a longitudinal edge 204*a* of a first elongated element 206*a*. The outermost end of the extension arm 203 includes a remote angled portion directed tangentially toward the mating interconnecting flange. A resilient barb pin 204, viewed in profile, is disposed at an outer end of the remote angled portion, forming an interlocking pin adapted for insertion into a complementary socket.

A second interconnecting fastener element 202*b* includes a cavity 201 with an elongated slot 209 open and facing the resilient barbed pin 204 of the first elongated section 206*a* when aligned thereto. Interlocking engagement can be accomplished by first aligning a leading end of the resilient barb pin 204 with the open elongated slot 209. The pin 204 and concave cavity 189 are longitudinally aligned and laterally displaced with respect to each other. The first and second elongated sections 206*a*, 206*b* are brought into engagement along their respective longitudinal edges 204*a*, 204*b*. The elongated slot 209 is dimensioned sufficiently to allow the resilient barbed pin 204 to enter into the cavity 201, but narrow enough to retain the resilient barbed pin 204 from exiting the cavity 201 along the same trajectory, thereby providing a one-way interlocking engagement. In some embodiments, one or more top and bottom ends of the cavity 201 are open allowing an alternative method of insertion or removal therefrom by longitudinal displacement as described above for the other interlocking fastener elements of FIGS. 4A through 4F.

Figure 6B:
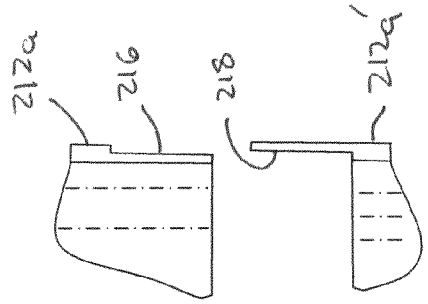
FIG. 6B shows in more detail, an exploded side elevation view of a portion of an end-to-end joint between longitudinally adjoining sections of the concrete column forms of FIG. 3A through FIG. 3D.
Figure 6A:
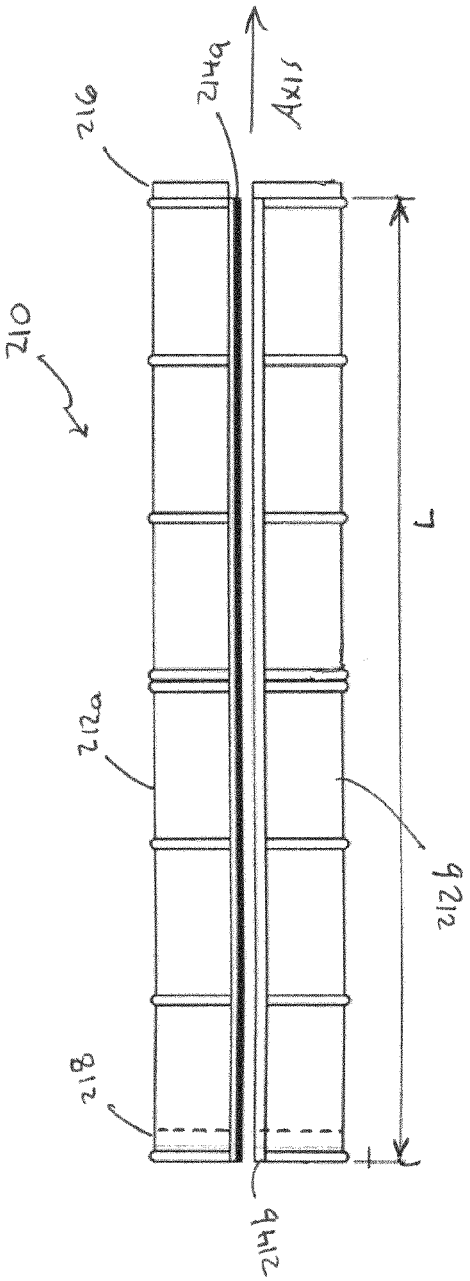
FIG. 6A shows an exploded side elevation view of another exemplary embodiment of a concrete column form constructed in accordance with the present invention.

Referring to FIG. 6A, an exploded side elevation view of another exemplary embodiment of a concrete column form constructed in accordance with the present invention is shown. The form assembly 210 includes at least two elongated sections 212*a*, 212*b* of length L. A first one of the elongated sections 212*a* includes along one longitudinal edge a first interlocking fastener element 214*a*. A second one of the elongated sections 212*b* includes a complementary second interlocking fastener element 214*b* configured for interlocking engagement with the first element 214*a*. In some embodiments, at least one of the first and second interlocking fastener elements extends along a substantial length of its respective elongated section 212*a*, 212*b*. For example, both of the interlocking fastener elements 214*a*, 214*b* can extend along nearly the entire length L of each section 212*a*, 212*b*.

In some embodiments, each of the elongated sections 212*a*, 212*b* includes an inner lip 216 at one end and at an outer lip 218 at an opposite end. An exploded side elevation view of a portion of an end-to-end joint between longitudinally adjoining sections of the concrete column forms is shown in more detail in FIG. 6B. When stacked end two end, the inner lip 216 of a first elongated section 212*a* is dimensioned to form an overlapping joint with the outer lip 218 of an adjoining elongated section 218. The resulting stacked form assembly 210 presents a substantially unbroken interior wall to form a substantially smooth column.

Figure 7:
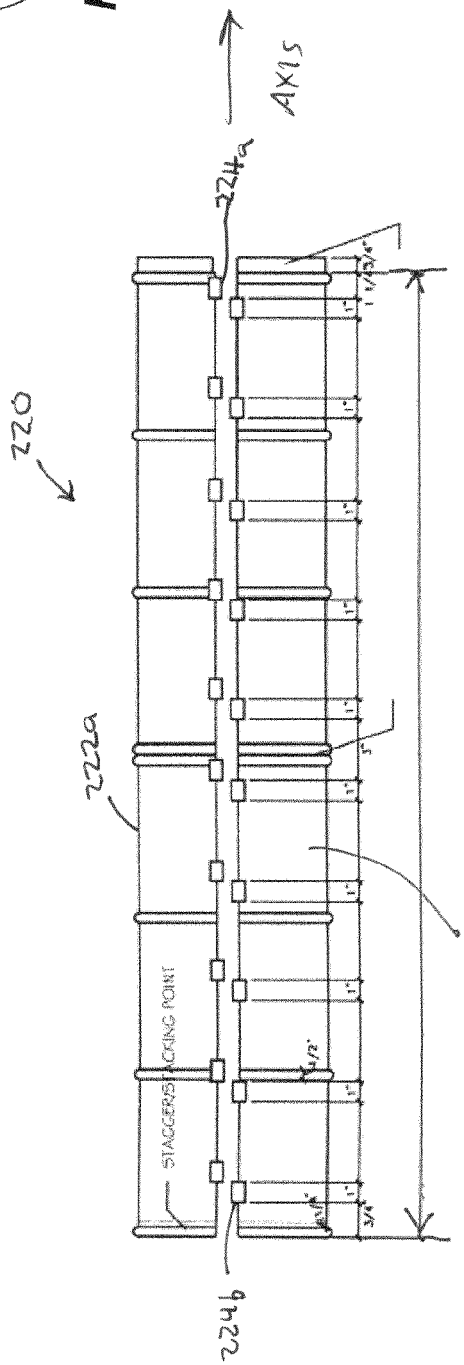
FIG. 7 shows an exploded side elevation view of another exemplary embodiment of a concrete column form constructed in accordance with the present invention.

Referring to FIG. 7, an exploded side elevation view of another exemplary embodiment of a concrete column form 220 constructed in accordance with the present invention is shown. A first elongated element 222*a* includes a first array of interlocking fastening elements 214*a* distributed along a common longitudinal edge. A second elongated element 222*b* includes a second array of complementary interlocking fastening elements 214*b* distributed along a common longitudinal edge. Each of the interlocking fastening elements 214*a*, 214*b* extends for a limited length along its respective longitudinal edge, such that gaps without interlocking elements exist between adjacent interlocking elements of each array. In some embodiments, the fastening elements 214*a* of the first array are longitudinally displaced from fastening elements 214*b* of the second array.

Figure 8:
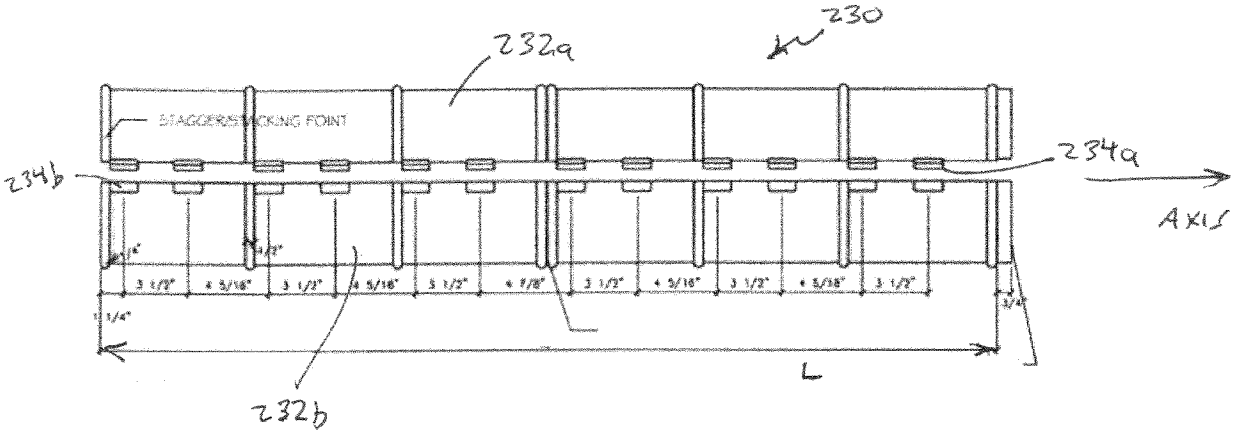
FIG. 8 shows an exploded side elevation view of another exemplary embodiment of a concrete column form constructed in accordance with the present invention.
Figure 9:
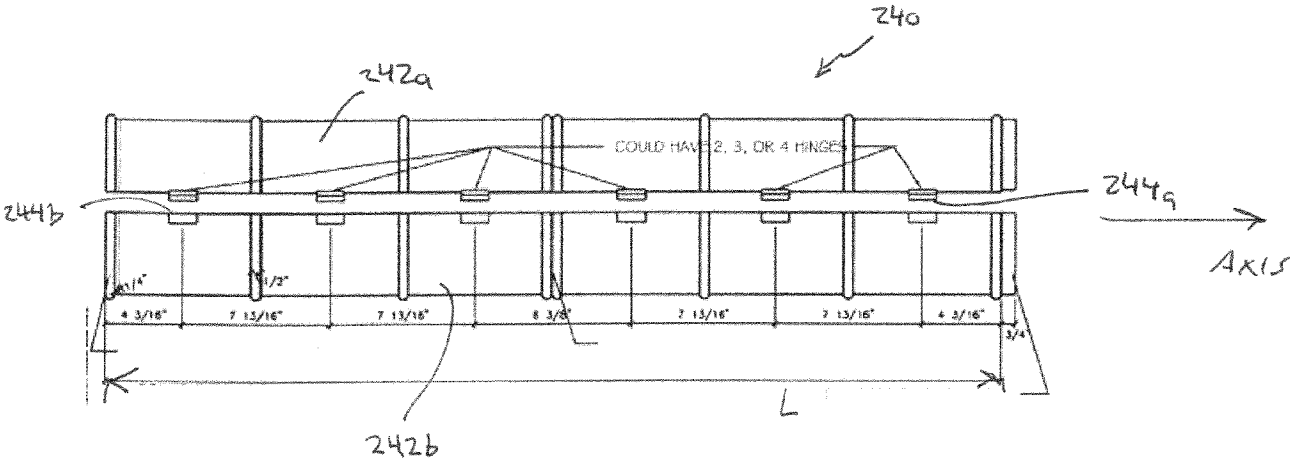
FIG. 9 shows an exploded side elevation view of yet another exemplary embodiment of a concrete column form constructed in accordance with the present invention.

Referring to FIG. 8, an exploded side elevation view of another exemplary embodiment of a concrete column form 230 constructed in accordance with the present invention is shown. The exemplary form 230 includes a first elongated element 232*a* with a first array of interlocking fastening elements 234*a* distributed along a common longitudinal edge and a second elongated element 232*b* with a second array of complementary interlocking fastening elements 234*b* distributed along a common longitudinal edge. Each of the interlocking fastening elements 214*a*, 214*b* extends for a limited length along its respective longitudinal edge, such that gaps without interlocking elements exist between adjacent interlocking elements of each array. Particularly, the fastening elements 234*a* of the first array are aligned with the fastening elements 234*b* of the second array when joined. An alternative embodiment of a form assembly 240 is shown in FIG. 9 having fewer fastening elements 244*a*, 244*b* along adjoining edges of the elongated sections 242*a*, 242*b*. The number and longitudinal extent of the fastening elements 244*a*, 244*b* can be varied depending upon the value of retaining force required by the application, a greater retaining force requiring a greater number of fastening elements 244*a*, 244*b*, longer individual fastening elements 244*a*, 244*b*, or a combination of more and wider fastening elements 244*a*, 244*b*.

Figure 10B:
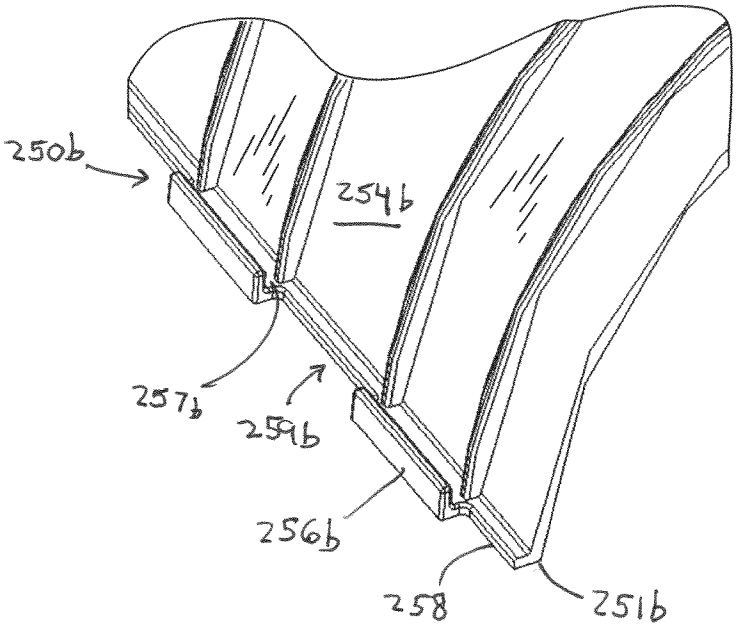
FIG. 10B shows a perspective view of a portion of an embodiment of a connecting flange configured to mate with the flange of FIG. 10A.
Figure 10A:
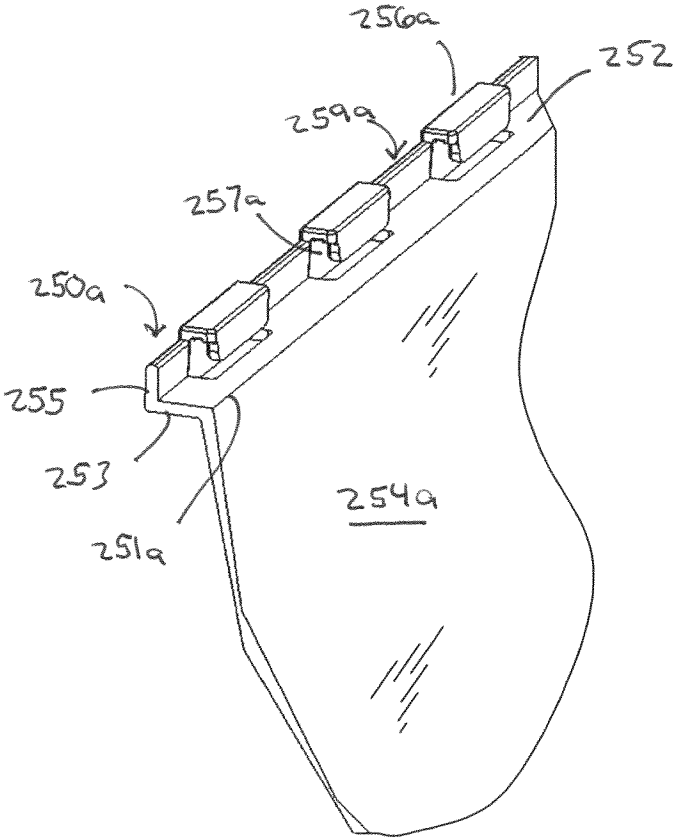
FIG. 10A shows a perspective view of a portion of an alternative embodiment of a connecting flange for use with the concrete column forms of FIG. 3A through FIG. 3D.

Referring to FIG. 10A, a partial perspective view of an end portion of an alternative embodiment of a first interconnecting flange 250*a* is shown for use in interconnecting adjacent section of a multi-segment concrete column form. The first interconnecting flange 250*a* includes a longitudinal channel 252 formed by an L bracket having first longitudinal member 253 extending away from a longitudinal edge 251*a* of the first elongated section 254*a* and a second longitudinal member 255 in an angular arrangement with respect to the first member 253. A first array of hooked interconnecting elements 256*a* is provided at an outer end of the L bracket. The hooks 256*a* bend radially inward having an opening facing the first longitudinal member 253. The hooks 256*a* provide a lateral opening 257*a* along at least one end to allow longitudinally sliding engagement with a corresponding hook of an adjoining elongated section. Preferably, adjacent hooks 256*a* are spaced apart from each other to allow for inter-digital alignment with the adjoining section.

A partial perspective view of an end portion of a connecting flange 250*b* configured to mate with the flange of FIG. 10A is shown in FIG. 10B. The second interconnecting flange 250*b* includes a longitudinal flange 258 extending away from a longitudinal edge 251*b* of a second elongated section 254*b*. A second array of hooked interconnecting elements 256*b* is provided along an outer end of the flange 258. The hooks 256*b* bend radially outward having an opening facing away from the longitudinal edge 251*b*. The hooks 256*b* provide a lateral opening 257*b* along at least one end to allow longitudinally sliding engagement with a corresponding hook of an adjoining elongated section. Preferably, adjacent hooks 256*b* are spaced apart from each other to allow for inter-digital alignment with the array of hooks 256*a* of the adjoining section 254*a*.

In a mating procedure, the longitudinal edge 251*a* of the first elongated section 254*a* is aligned adjacent to the longitudinal edge 251*b* of the second elongated section 254*b*, such that the second array of hooks 256*b* fits within openings 259*a* between the first array of hooks 256*a* and the first array of hooks 256*a* fits within openings 259*b* between the second array of hooks 256*b*. The adjacent longitudinal edges 251*a*, 251*b* are urged against each other, such that an outer surface of the flange 258 abuts an interior surface of the first longitudinal member 253. At this juncture, open ends 257*a* of the first array of hooks 256*a* face open ends 257*b* of the second array of hooks 256*b*. The first elongated section 254*a* is translated longitudinally with respect to the second elongated section 254*b*, with the outer surface of the flange 258 sliding along a bearing surface of the first longitudinal member until the first array of hooks 356*a* overlaps the second array of hooks in an interlocking engagement. The interlocking hooks provide a retaining force to keep adjacent elongated sections 254*a*, 254*b* together during use. In some embodiments, a stop is provided to inhibit further translation of the two elongated sections 254*a*, 254*b* when the hooks 256*a*, 256 are engaged.

FIG. 11A, FIG. 11B, and FIG. 11C show an alternative embodiment of a concrete column form section. A first elongated section 262*a* includes a flat rectangular wall section formed from a flexible material. The flexible wall section 262*a* includes a first interconnecting fastener element 264*a*' along a longitudinal edge and a second interconnecting fastener element 264*a*" along an opposite longitudinal edge. The first and second interconnecting fastener elements 264*a*', 264*a*" can be the same or different. In some embodiments, different corresponding fastening elements 264*a*', 264*a*" are provided along opposite longitudinal edges, such that more than one identical elongated section 262*a* can be interconnected together along adjoining longitudinal edges. In general, the interlocking fastener elements 264*a*', 264*a*" can be any suitable design, including any of the types described herein. As illustrated, one of the fastener elements includes a resilient barb 264*a*" adapted for interconnection with an open cavity of the other fastener element 264*a*'.

Beneficially, the flexible wall section 262*a* can be bent around a portion of a longitudinal axis to form a section of a circular column. One or more additional wall sections 262*a*, 262*b*, 262*c*, 262*d* can be interconnected as just described and bent about the axis to form a complete closed circular cylinder form assembly 260. Sections of the same or different sizes can be interconnected to form columns of various diameters. For example, two identical 9.42-inch wide sections can be combined to form a 6-inch diameter column. A third identical section can be added to form a 9-inch diameter column and a fourth identical section can be added to form a 12-inch diameter section.

In some embodiments, the wall sections 262*a* can include thickened areas forming reinforcing ribs 265. Alternatively or in addition, the wall sections 262*a* can include an inner lip 266*a* at one end and an outer lip 268*a* at an opposite end to allow stacking as described herein. The wall sections 262*a* are formed from a flexible material of sufficient strength to retain a material poured into a form assembly 260. Strength can be controlled by one or more of a choice of material, wall thickness, and inclusion reinforcing ribs 265. Preferably the material is minimally elastic to prevent deformation from weight of the poured material. The form assembly 260 can be left attached after the poured material sets, or removed for reuse as for the rigid wall sections described above.

Figure 12C:
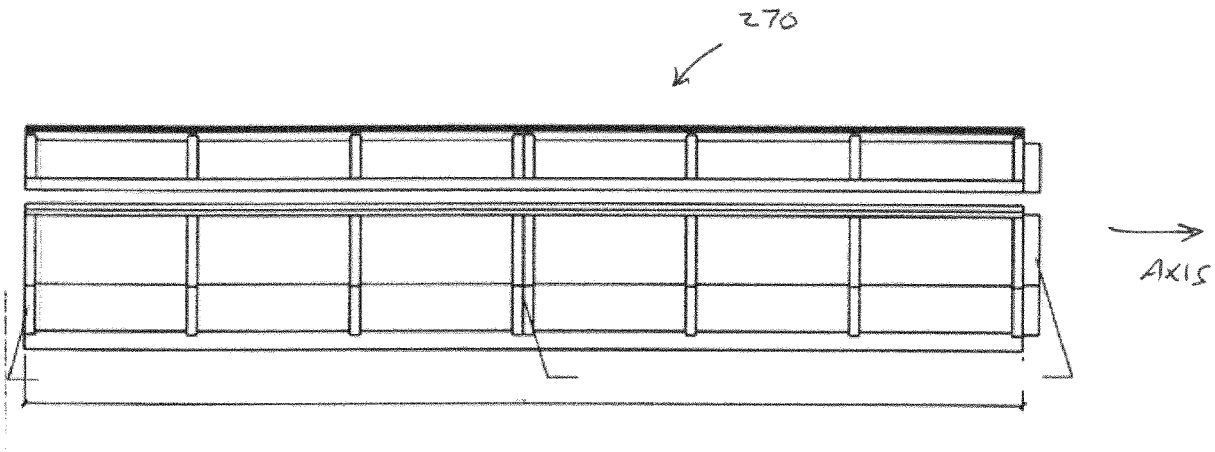
FIG. 12C shows an exploded side elevation view of the concrete column forms shown in FIG. 12A and FIG. 12B.
Figure 12B:
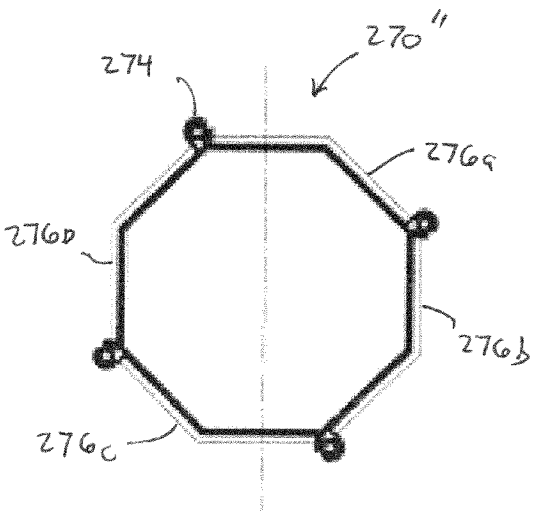
FIG. 12B shows an end view of an additional exemplary embodiment of a concrete column form constructed in accordance with the present invention
Figure 12A:
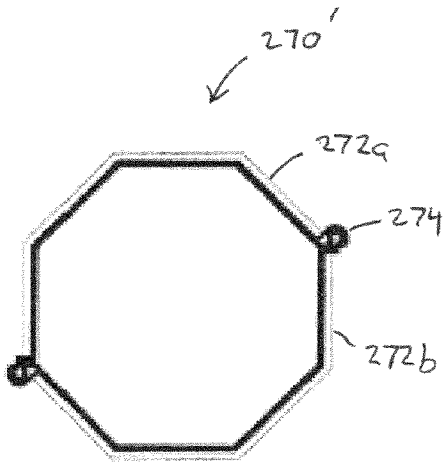
FIG. 12A shows an end view of another exemplary embodiment of a concrete column form constructed in accordance with the present invention.

More generally, the elongated sections can be prepared to form poured columns of any desired cross section. Cross sectional shapes include ellipses, circles, polygons, and combinations of straight and curved surfaces. Referring to FIG. 12A, FIG. 12B, and FIG. 12C another exemplary embodiment of an octagonal concrete column-forming assembly 270 is shown constructed in accordance with the present invention. The form assembly 270 is formed from two or more elongated sections forming respective portions of the octagonal column. For example, a first form assembly 270' includes two elongated sections 272*a*, 272*b*, each respectively forming four different flat surfaces of the octagonal column. Each of the elongated sections 272*a*, 272*b* includes one or more interlocking fastener elements 274 configured to interlock with complementary fastener elements of an adjacent elongated wall section. Beneficially, the angular elongated wall sections 272*a*, 272*b* stack in a condensed configuration similar to that shown in FIG. 2 for ease of transport and storage. An alternative embodiment is shown in FIG. 12B having four elongated wall sections 276*a*, 276*b*, 276*c*, 276*d* (generally 276). Each of the four elongated wall sections 276 respectively forms two different flat surfaces of the octagonal column.

Figure 13C:
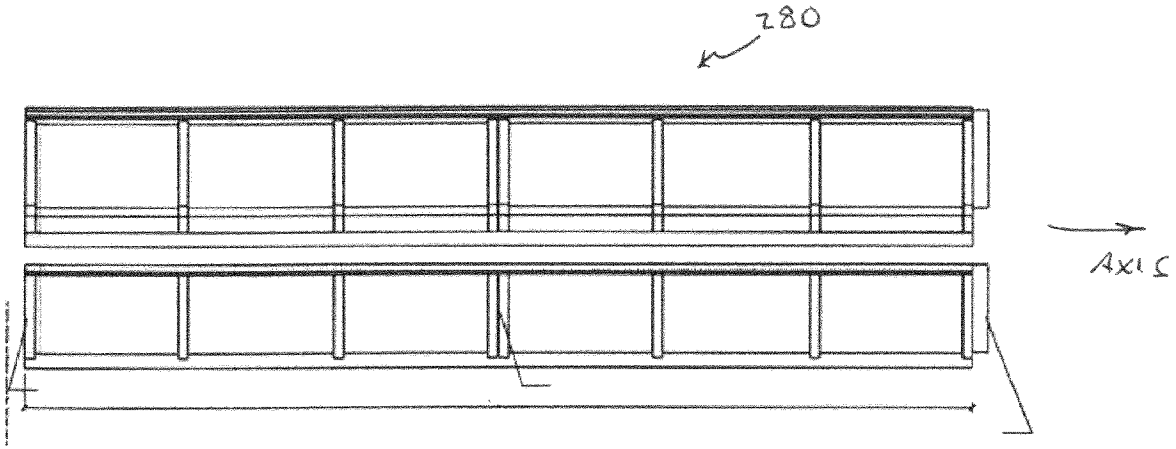
FIG. 13C shows an exploded side elevation view of the concrete column forms shown in FIG. 13A and FIG. 13B.
Figure 13B:
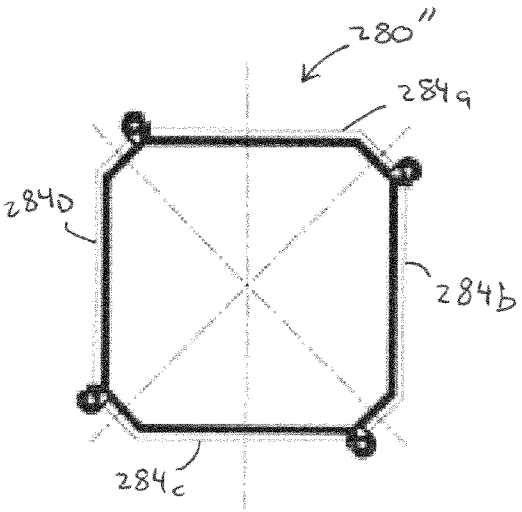
FIG. 13B shows an end view of an additional exemplary embodiment of a concrete column form constructed in accordance with the present invention
Figure 13A:
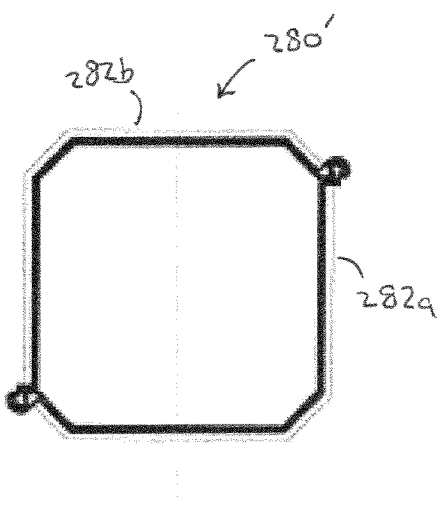
FIG. 13A shows an end view of another exemplary embodiment of a concrete column form constructed in accordance with the present invention.

The shape of the elongated wall sections can be varied to provide other shapes, such as rectangular column having beveled corners. That is, a rectangular column having four sides with four beveled corners for a total of eight flat surfaces. A beveled rectangular column-form assembly 280 for forming such a column is shown in FIG. 13A, FIG. 13B, and FIG. 13C and can be constructed according to the techniques described herein. Exemplary form assemblies 280' having two elongated sections 282*a*, 282*b* and 280" having four elongated sections 284*a*, 284*b*, 284*c*, 284*d* are shown.

Figure 14:
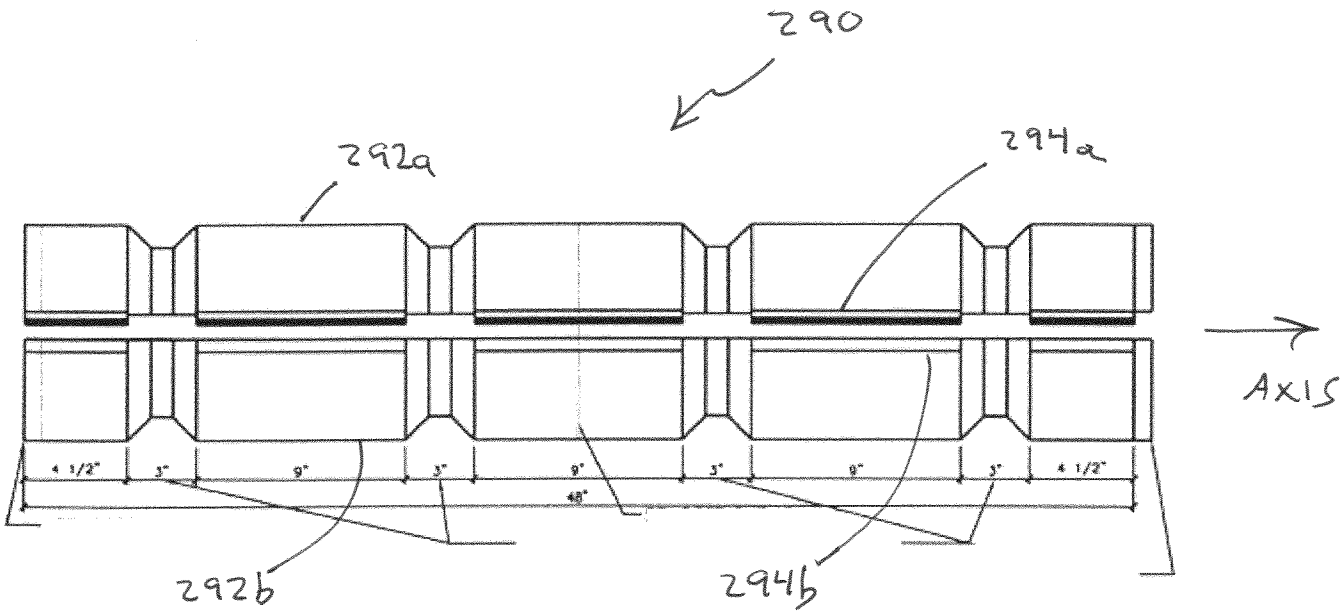
FIG. 14 shows an exploded side elevation view of another exemplary embodiment of a concrete column form constructed in accordance with the present invention.

In some embodiments, the column forming assembly forms a column having variations along its axis. Referring to FIG. 14, an exploded side elevation view is shown of an exemplary embodiment of a concrete column form 290 constructed in accordance with the present invention. First and second elongated sections 292*a*, 292*b* (generally 292) provide interior walls having variations along the length, such as the regular repeating pattern shown. Columns formed with such an assembly 290 have corresponding radial variations along their length. At least some portions of a longitudinal edge of each section 292 include one or more interlocking fastener elements 294*a*, 294*b* configured to interlock the two or more sections together. Any of the interlocking fasteners described herein can be used.

Referring to FIG. 15A through FIG. 15F, each shows an exploded top perspective view of a respective embodiment of a concrete column-end forming kit for constructing a column-end forming extension assembly in according to principles of the present invention. Each column-end forming kit 300 includes at least two sections 302*a*, 302*b* configured to be secured together prior to use. The form assembly 300 includes a first end 306 and a second end 308. At least one of the two ends 306, 308 is configured to interconnect with a column forming assembly. The column forming assembly (not shown) can be any of the assemblies described herein, or other assemblies, such as single piece hollow tubes commonly used in construction. The column-end forming assembly 300 provides a form into which a material such as concrete is poured to form an end feature of a column. The end feature may be a base or a capital or two column end forming assemblies 300 can be used simultaneously to form both a base and a capital. Each column end forming assembly 300 includes at least one open end when assembled into which a column forming material can flow. As a base feature, the column end forming assembly 300 includes at least a top opening in fluid communication with a column form to allow material poured in from a top of the form to flow. As a capital feature, the column end forming assembly 300 can include openings at both ends, a top end to accept a pour and a bottom end in fluid communication with a column form to allow transfer of the pour to lower parts of the column.

Figure 15B:
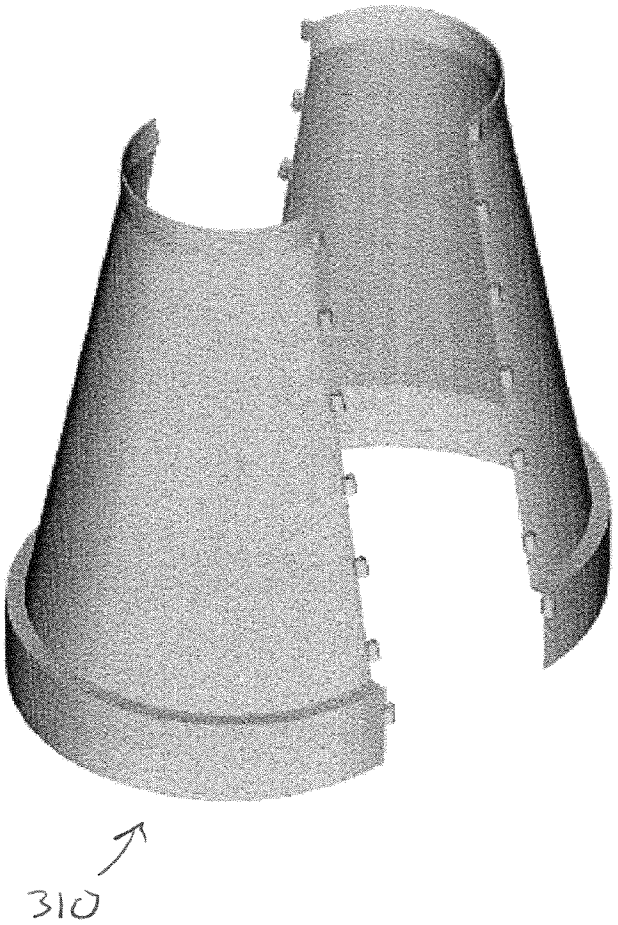
FIG. 15A through FIG. 15F each show an exploded top perspective view of a respective embodiment of a concrete column end forming assembly constructed in according to principles of the present invention.
Figure 15A:
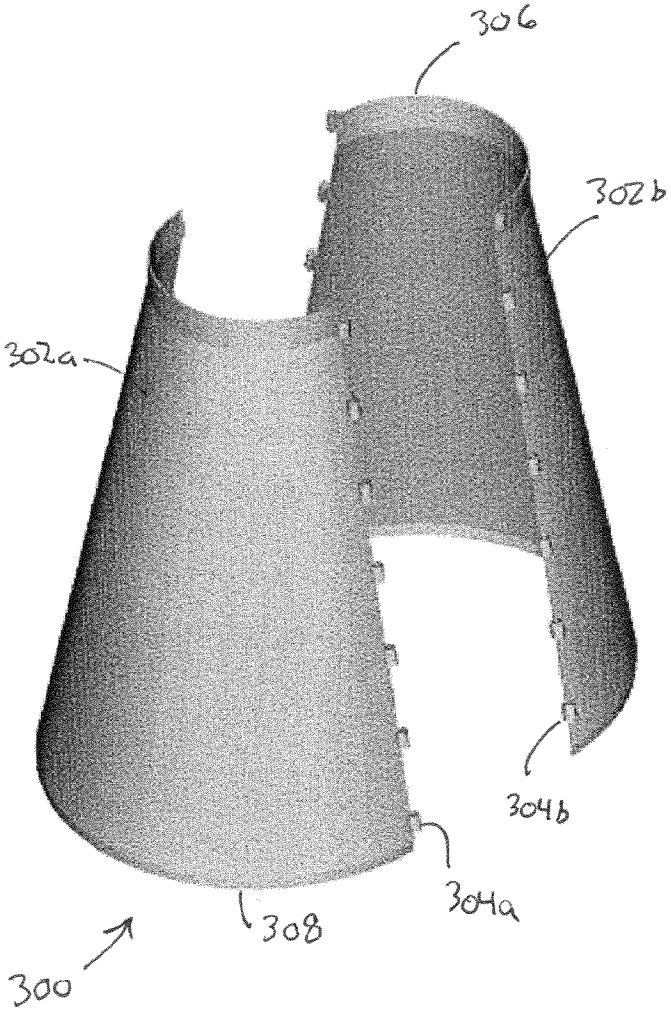
Figure 15D:
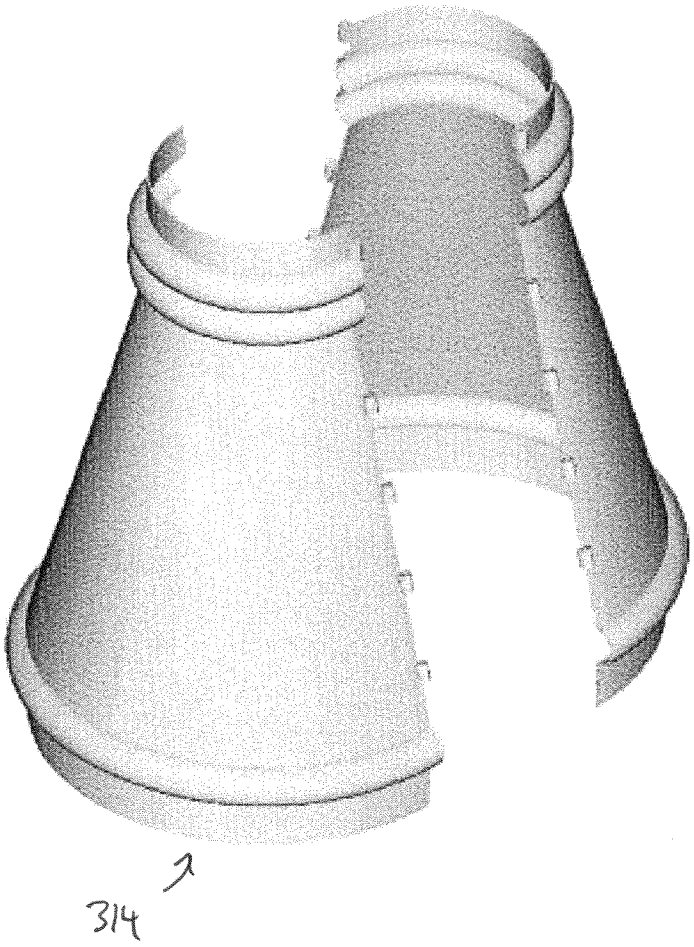
Figure 15C:
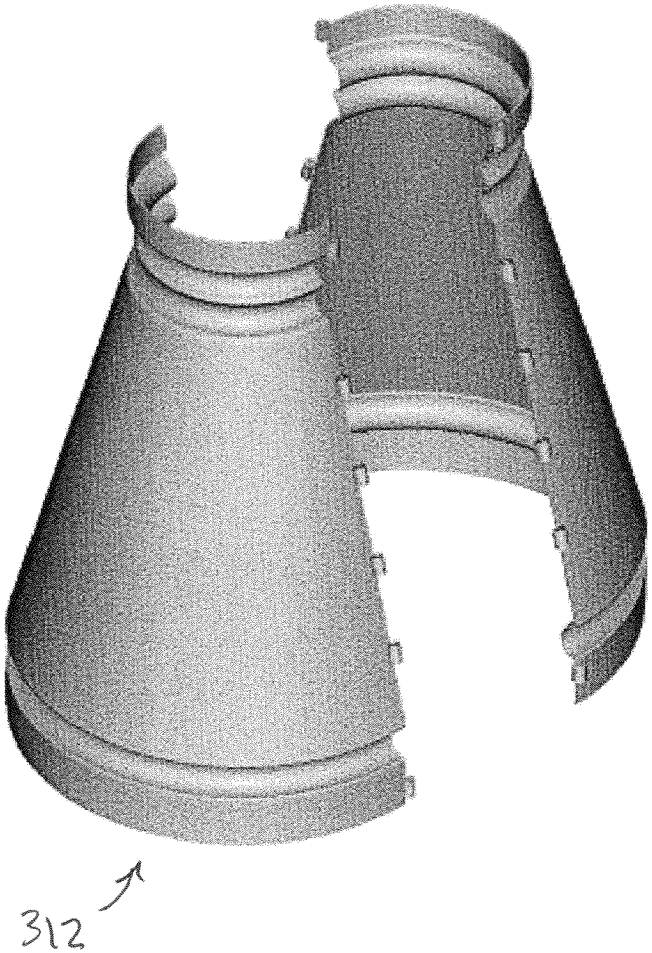
Figure 15F:
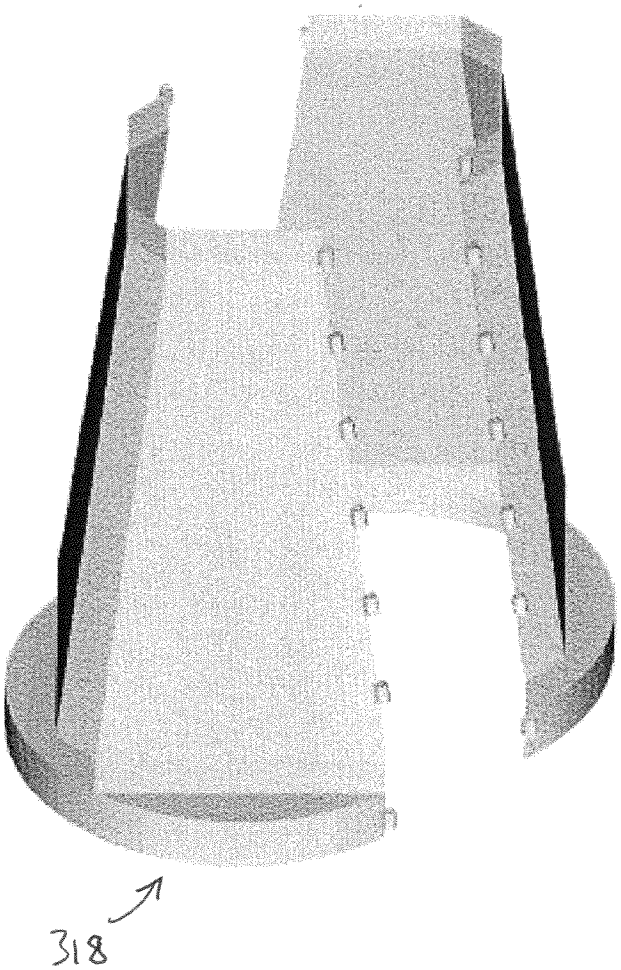
Figure 15E:
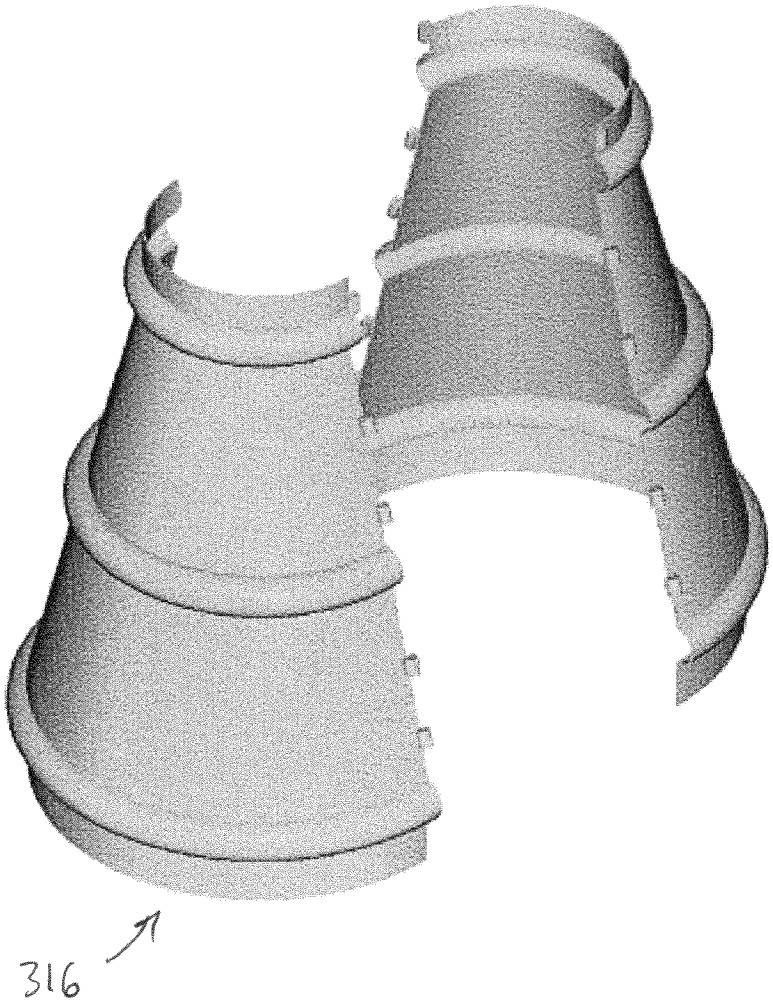

In some embodiments, each section 302*a*, 302*b* of the column end forming assembly 300 includes at least one interlocking fastener element 304*a* along a longitudinal edge configured to interlock with at least one corresponding fastener element 304*b* along a longitudinal edge of an adjacent section 302, the fastener elements positioned for interlocking engagement be secure sections 302 together prior to use. The column end shape is controlled by the shape of the column end forming assembly 300. A variety of conically shaped forms 300, 310, 312, 314, 316 with various design details are shown in FIG. 15A through FIG. 15E. An exemplary pyramidal form 318 is shown in FIG. 15F.

Figures 16A, 16B:
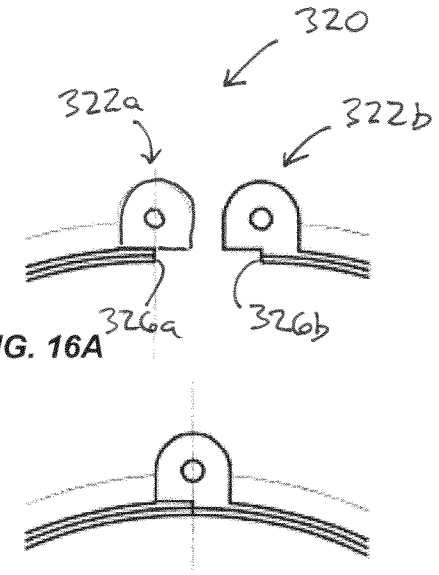
FIG. 16A and FIG. 16B show an end view of still another exemplary embodiment of connecting flanges for use with the concrete column end forms of FIG. 15A through FIG. 15F, in which the connecting flanges are respectively shown unmated and mated.
Figure 17B:
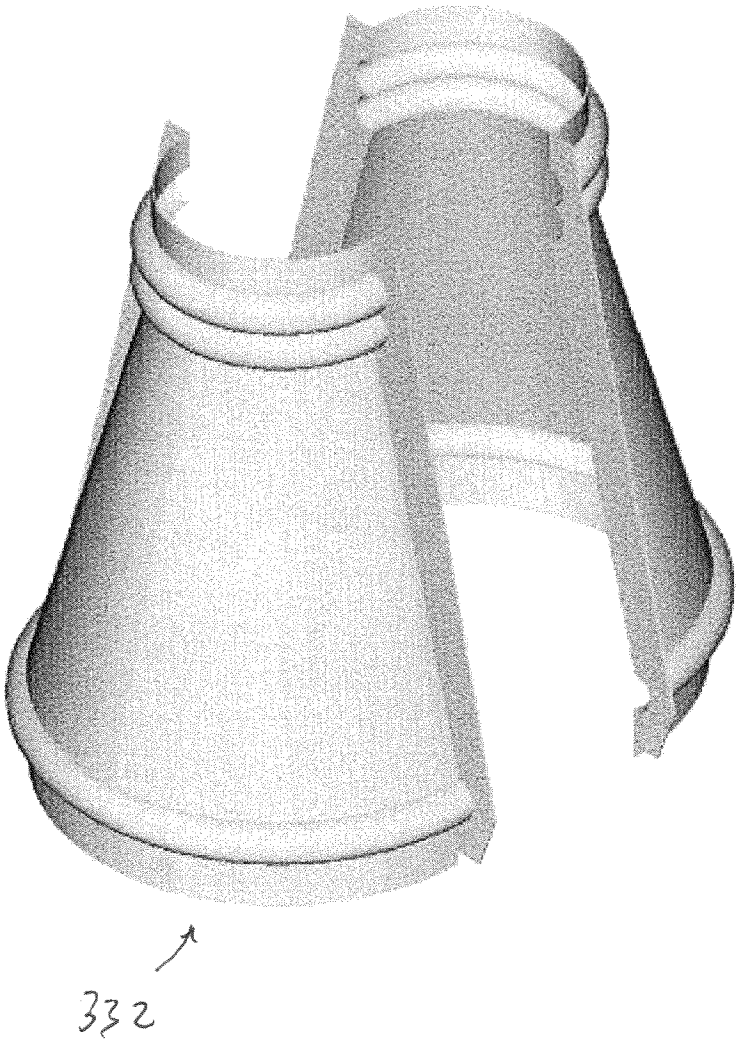
FIG. 17A through FIG. 17D each show an exploded top perspective view of a respective embodiment of a concrete column end forming assembly constructed in accordance to principles of the present invention.
Figure 17A:
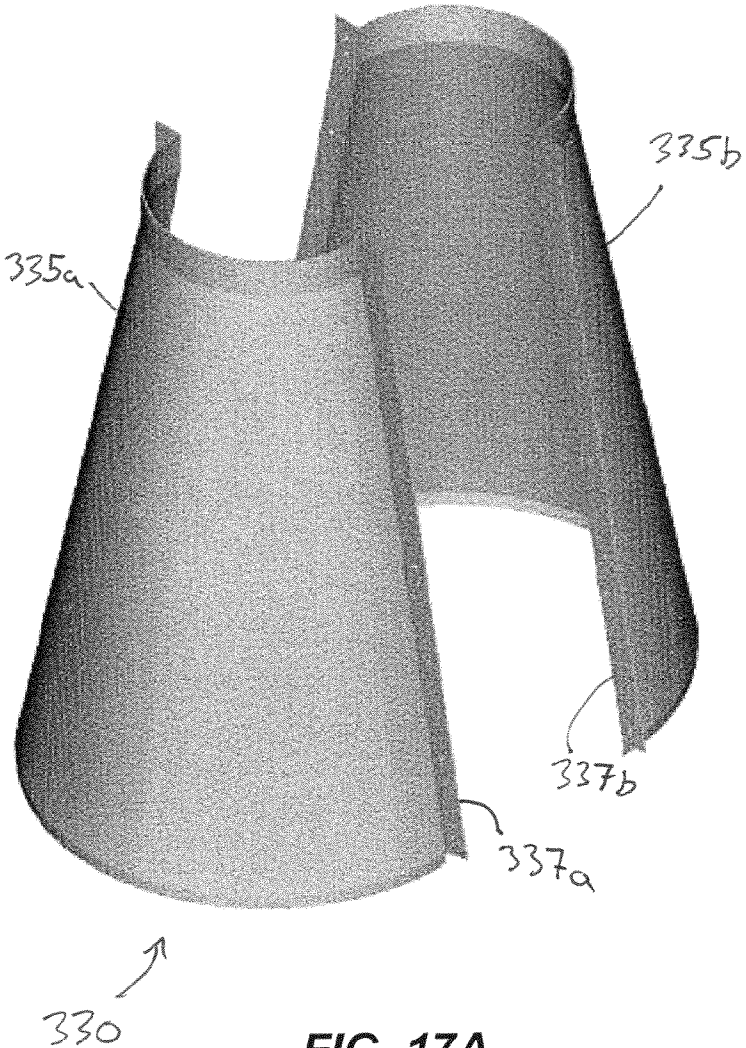
Figure 17D:
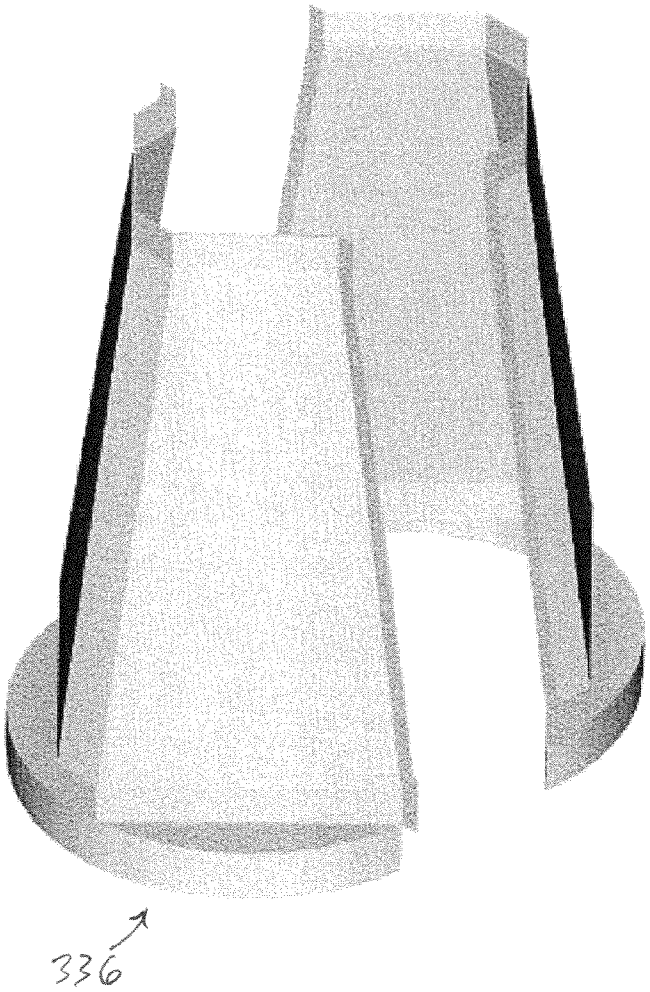
Figure 17C:
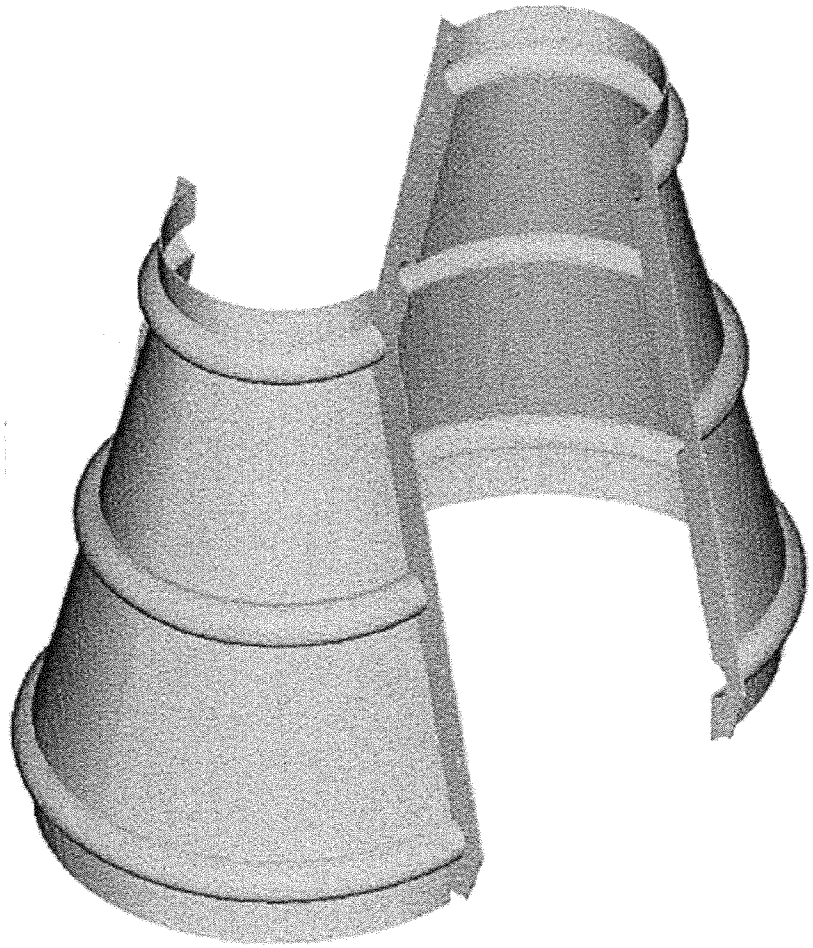

Referring to FIG. 16A and FIG. 16B, a sectional view is shown of still another exemplary embodiment of connecting flanges 320 for use with the concrete column forms of FIG. 15A through FIG. 15F, in which the connecting flanges 322*a*, 322*b* are respectively shown unmated and mated. A first connecting flange 322*a* is provided along a longitudinal edge of one form section 324*a*. The flange extends radially outward and tangentially away from the longitudinal edge 326*a* and includes an axial bore therethrough. A second connecting flange 322*b* is provided along a longitudinal edge of another form section 324*b*. The second connecting flange 322*b* also extends radially outward and tangentially away from the longitudinal edge 326*b* including an axial bore therethrough. The flanges 322*a*, 322*b* are axially displaced with respect to each other such that they overlap when joined, the central bores being aligned with respect to each other. To retain interlocking engagement, a separate member, such as an interlocking pin, is inserted into and extending through at least a portion of each bore. The interlocking pin can be a nail, a screw, wire, or any suitable hardware. When inserted into the bores, the pin (not shown) prohibits separation of the aligned flanges, thereby preventing separation of the adjoined form sections 322*a*, 322*b*. In some embodiments, the fastening pin can be removed to allow separation of the form sections 322*a*, 322*b* after material poured therein has sufficiently cured.

Figure 18B:
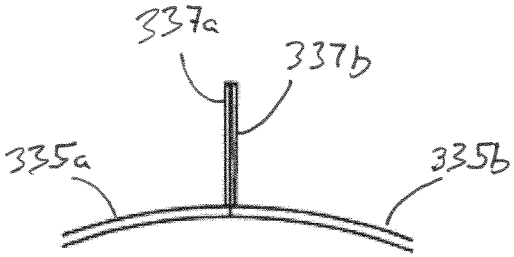
FIG. 18A and FIG. 18B show an end view of still another exemplary embodiment of connecting flanges for use with the concrete column end forms of FIG. 17A through FIG. 17F, in which the connecting flanges are respectively shown unmated and mated.
Figure 18A:
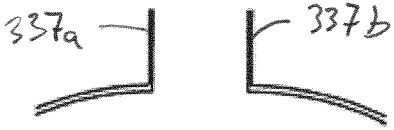

Alternative embodiments of column end forming assemblies 330, 332, 334, 336 are illustrated in exploded view in FIG. 17A through FIG. 17F. Each of the exemplary column end forming assemblies includes at least two form sections 335*a*, 335*b*. Each form section 335*a*, 335*b* respectively includes a flange 337*a*, 337*b* extending along at least a portion of a longitudinal edge of the form. The flanges are substantially flat, extending radially outward and configured to abut with similar flange of an adjacent wall section as shown in FIG. 18A and FIG. 18B. Adjacent flange sections can be clamped together providing a retaining force to keep adjacent sections joined together. Clamping can be provided by chemical adhesives, thermal bonding or welding, or mechanical clamps. Mechanical clamps can include c-clamps, or fastening hardware such as nails, screws, bolts, and nuts.

Figure 19A:
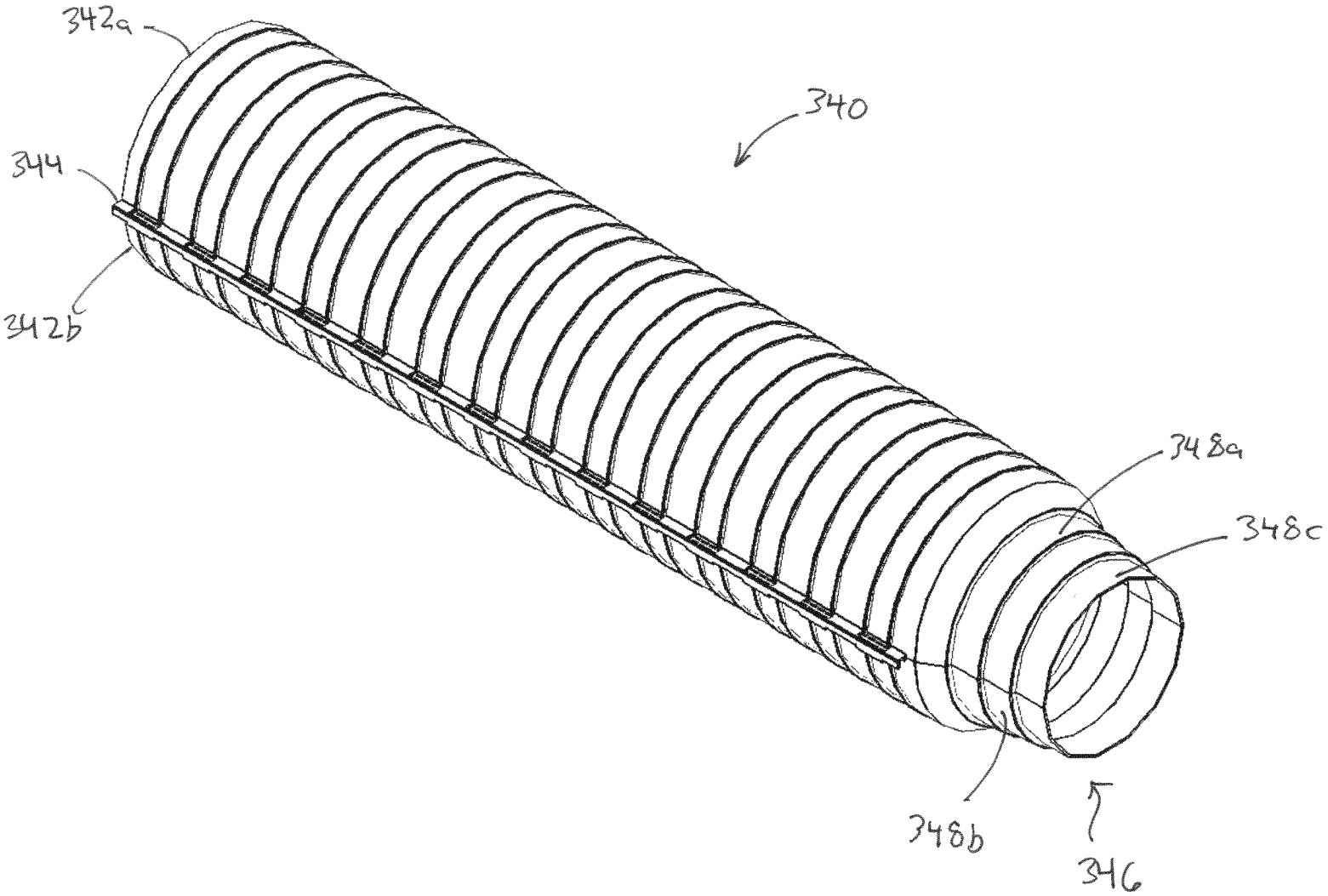
FIG. 19A shows a perspective view of one embodiment of an assembled concrete column forming assembly having a tapered end constructed in accordance to principles of the present invention.

In some embodiments, at least one end of the column-forming assembly includes a taper to facilitate interconnection with another column form or column end form having a different diameter. Referring to FIG. 19A, a perspective view of one embodiment of an assembled concrete column forming assembly 340 is shown having a tapered end 346 constructed in accordance to principles of the present invention. The column forming assembly includes at least two sections 342*a*, 342*b* retained together using interlocking fastening means 344, such as any of the means described herein. The tapered end can be a continuous taper, such as a cone, or a stepped taper, as shown. Thus, the form assembly 340 forms a column having a first diameter D. A taper 348*a* is provided at one end to a lesser diameter D1. Additional stepped tapers 348*b*, 348*c* can be provided further reducing the diameter: D3<D2<D1<D. The tapered end can provide an opening to allow fluid communication between the form assembly 340 and the smaller diameter interconnected form. Tapers could also be provided to transition to larger diameters, with each tapered segment accommodating column forms having greater diameters. In use, the tapered end is joined to the different sized form. This can be accomplished by simply inserting the tapered end 346 into the reduced size column form.

Figure 19B:
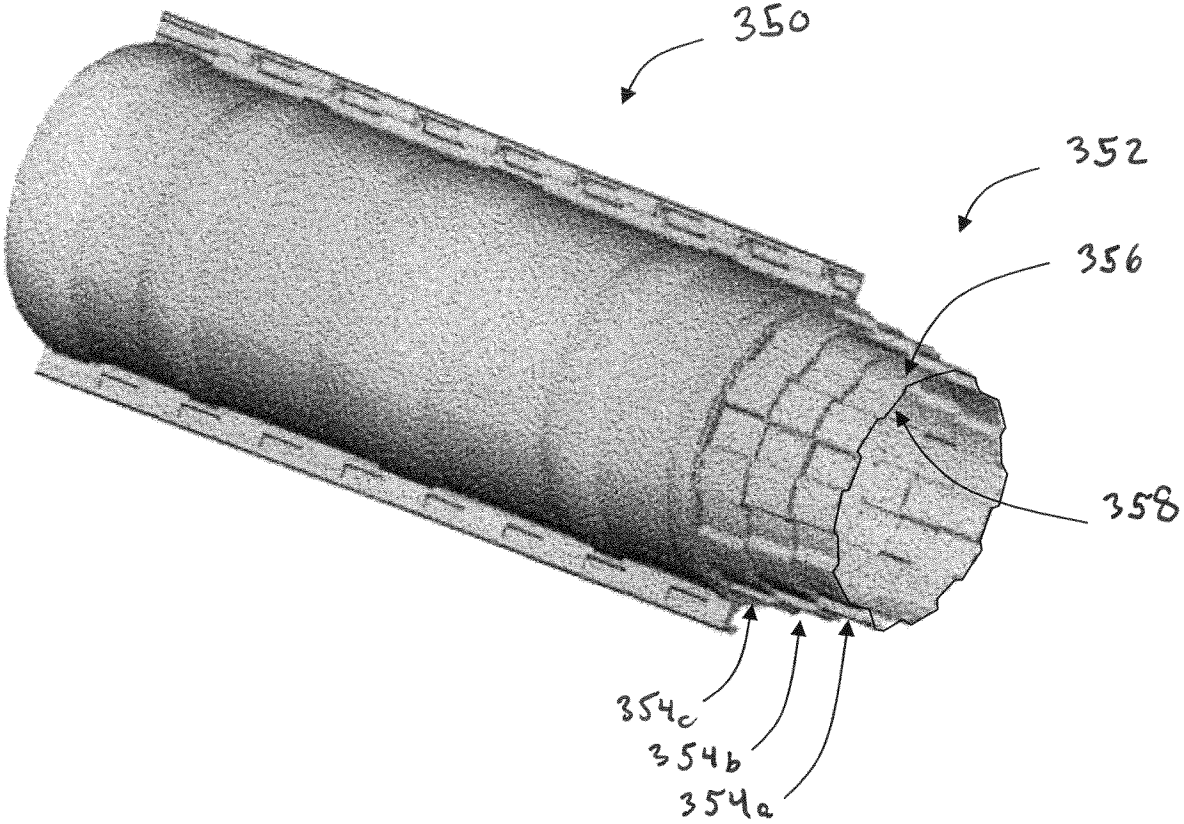
FIG. 19B shows a perspective view of one embodiment of an alternative embodiment of an assembled concrete column forming assembly having a tapered end constructed in accordance to principles of the present invention.

Referring to FIG. 19B, a perspective view of another embodiment of an assembled concrete column forming assembly 340 is shown having an alternative tapered end 352 constructed in accordance to principles of the present invention. The tapered end 352 includes one or more sleevelets, or neck segments 354*a*, 354*b*, 354*c* (generally 354) that include protrusions 356 extending laterally outwardly from an outer surface 358 of the segments 354. The protrusions 356 frictionally engage an inner surface of a pillar form, while also preventing the inner surface of the pillar form from engaging the outer surface 358 of the segments 354. The protrusions 356 accordingly, make placing another form, such as an adjoining tubular pillar form, onto the column forming assembly 350 easier since the total contact area between the forms is reduced, thereby reducing friction. In addition, the protrusions 356 more easily accommodate cross-sections of any adjoining forms that have been damaged and misshapen during shipping and handling prior to the adjoining forms being placed on the column forming assembly 350. The protrusions 356 can be uniformly spaced around the neck segments 354 and are arranged in at least one annular array coaxial with the axis. Each protrusion 356 of the array preferably extends a uniform distance from the axis of the column forming assembly 350 to define an outermost periphery of the array.

Figure 20B:
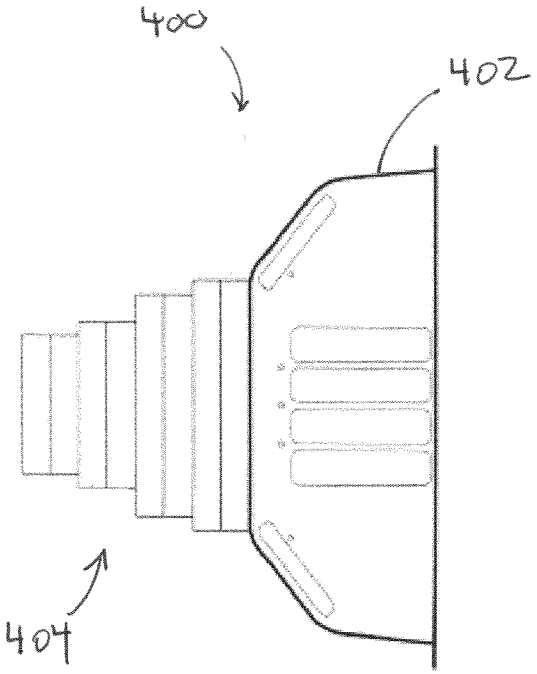
FIG. 20B shows a side elevation view of the footing form shown in FIG. 20A.
Figure 20A:
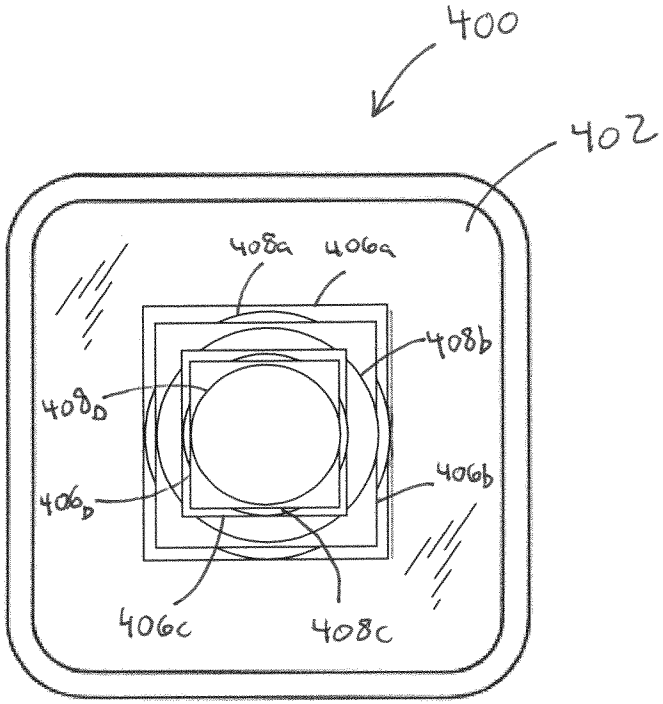
FIG. 20A shows a plan view of one embodiment of an exemplary embodiment of a footing form constructed in accordance with the present invention.

Referring to FIG. 20A and FIG. 20B, plan and side elevation views are respectively shown for an exemplary embodiment of a footing form including neck portion adapted to interconnect with differently shaped column forms. Footings for poured structures providing a tapered neck portion are described in commonly assigned U.S. Pat. No. 6,543,742, issued on Apr. 8, 2003 and claiming priority to U.S. Provisional Application No. 60/246,245, filed on Nov. 6, 2000, incorporated herein by reference in their entirety. The tapered sleevelets or neck portion described therein is suitable for a variety of standard sized circular columns. The inventive footing form 400 includes a relatively wide base portion 402 and neck portion 404 extending from one end of the base portion 402. The neck portion 404 includes a first neck segment 406*a* adjacent to the top of the base portion 402. In this example, the first neck segment 406*a* is a square of outside dimension D1. Extending away from the top of the base portion, a second neck segment 408*a* is positioned adjacent to the first neck segment 406*a*. The shape of the second neck segment 408*a* is different from the shape of the first neck segment 406*b*. In this example, the second neck segment 408*a* is a circle of outside diameter D1. Thus, the same neck portion 404 of the footing form 400 is able to accommodate a square column form of inside dimension D1 or a circular column form of inside diameter D1. The form includes an open end facing the interconnected column form to allow fluid communication between the form and the footing 400.

In some embodiments, further neck segments are provided to accommodate still other columns of different forms and or similar forms and different sizes. In the exemplary embodiment, the neck portion 404 includes a third neck segment 406*b* adjacent to the top of the second neck segment 408*a*. In this example, the second neck segment 406*b* is also a square of outside dimension D2. Extending away from the top of the base portion, a fourth neck segment 408*b* is positioned adjacent to the third neck segment 406*b*. The shape of the fourth neck segment 408*b* is different from the shape of the third neck segment 406*b*. In this example, the fourth neck segment 408*b* is a circle of outside diameter D2. Thus, the same neck portion 404 of the footing form 400 is able to accommodate a square column form of inside dimension D1 or D2 (D2<D1) or a circular column form of inside diameter D1 or D2 (D2<D1). The pattern may be continued in the stacked arrangement as shown with still further circular segments 406*c*, 406*d* of reducing diameter (e.g., D4<D3<D2<D1) interspersed with square segments 408*c*, 408*d* of reducing dimension (e.g., D4<D3<D2<D1). In some embodiments, unused distal segments of the neck portion are removed by cutting or otherwise separating the segments from the footing 400. This provides a maximal opening to the footing to promote adequate transfer of a poured material into the footing through its open end.

In some embodiments, one or more of the neck segments 406, 408 can include protrusions (not shown) extending laterally outwardly from an outer surface of the one or more segments 406, 408 for frictionally engaging an inner surface of a pillar form as described above in reference to FIG. 19B and in U.S. Pat. No. 6,543,742.

Although the circles are shown as being transcribed to a maximal dimension within a square (i.e., the diameter of the circle is equivalent to a side of the square), there is no requirement that this be true in every case. The general shapes and sizes can be chosen to accommodate any selection of differently sized and shaped column forms. The footing 400 can be used with multi-section column forming assemblies, such as those described herein. Alternatively or in addition, the footing 400 can be used with any column form including those commercially available at the time of this application.

Figure 21B:
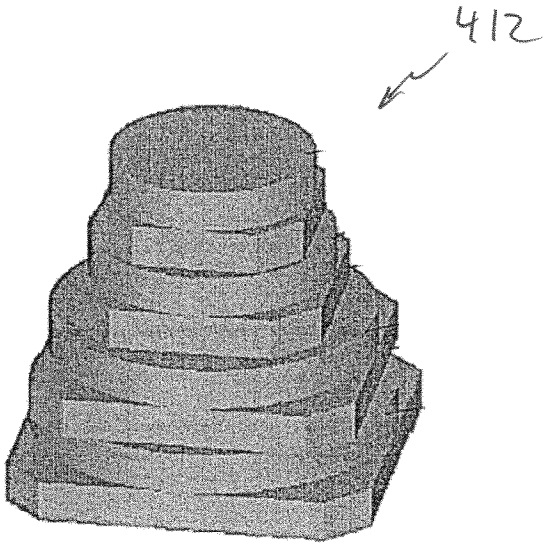
FIG. 21B shows a top perspective view of an alternative embodiment of a neck portion constructed in accordance with the present invention.
Figure 21A:
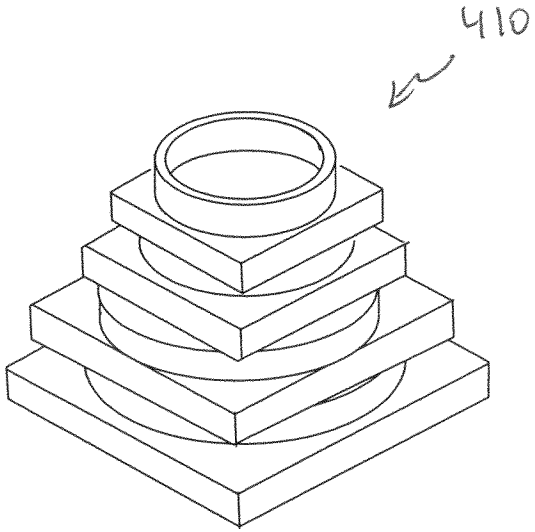
FIG. 21A shows a top perspective view of a neck portion view of the footing shown in FIG. 20A and FIG. 20B.

A top perspective view of the exemplary neck portion 410 is shown in more detail in FIG. 21A. At least one opening 411 is provided at a column-facing end of the neck portion 410. Although the neck portion 410 is shown with varied shapes of reducing diameters, other embodiments are possible in which the diameters of the various shapes increase in a direction away from a top of the footing. An alternative embodiment of a neck portion 412 is illustrated in FIG. 21B, in which circular neck segments 413 are interspersed with square neck segments having beveled corners—i.e., octagonal neck segments 414.

Figure 22C:
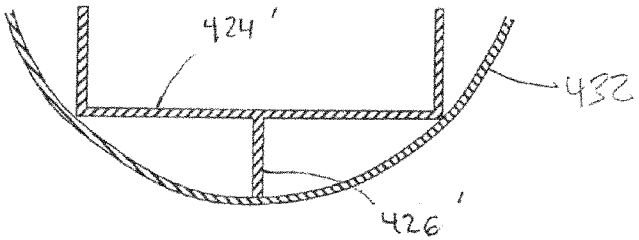
FIG. 22C shows a sectional view of a portion of the concrete column form—insert assembly shown in FIG. 22B.
Figure 22B:
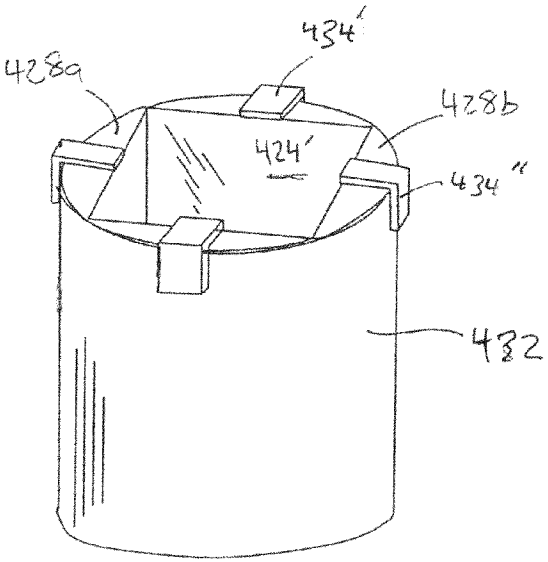
FIG. 22B shows a top perspective view of a portion of a concrete column form containing the concrete column form insert assembly shown in FIG. 22A.
Figure 22A:
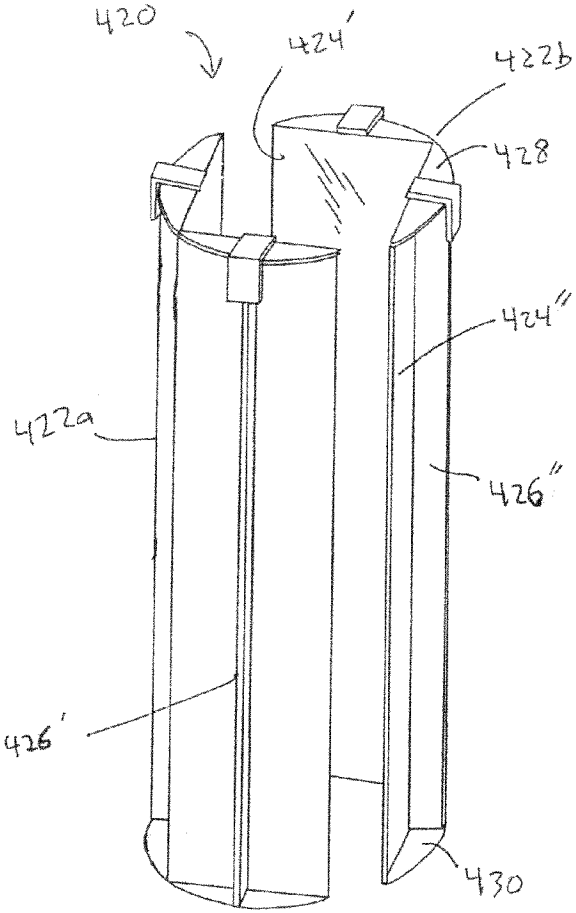
FIG. 22A shows an exploded top perspective view of one embodiment of a concrete column forming insert assembly constructed in according to principles of the present invention.

A column insert can be used together with a column form to change or otherwise customize a shape of a column formed therewith. Referring to FIG. 22A, an exploded top perspective view of is shown one embodiment of a concrete column forming insert assembly 420 constructed in according to principles of the present invention. The column forming insert assembly 420 includes at least one thin-walled elongated insert adapted for insertion into any of the column-forming assemblies described herein, or any other column form including those commercially available at the time of this application. In the exemplary embodiment, the insert assembly 420 includes two substantially identical thin-walled elongated insert segments 422*a*, 422*b*. The insert assembly is adapted to form a column that is rectangular in cross section by using a column form that is circular in cross section. Each of the elongated insert segments 422*a*, 422*b* (generally 422) includes a first elongated wall segment 424' and a second elongated wall segment 424". The two elongated wall segments 424', 424" (generally 424) are joined along adjacent longitudinal edges forming a right angle therebetween. Each of the wall segments 424 includes at least one reinforcing rib 426', 426" (generally 426) for reinforcing the thin walled insert segment 422 during use. For example, a longitudinal rib 426 can be centrally located along the wall segment 424, extending longitudinally along the entire length of the wall 424. A cross sectional view of a central rib is illustrated in FIG. 22C. Additional longitudinal rib sections can be provided, for example, along either side of the central rib 426." Alternatively or in addition, one or more transverse rib segments (not shown) can be provided extending between the wall segment 424 and an interior surface of the column forming tube.

The elongated insert segments 422*a*, 422*b* are generally dimensioned to be equal in length or less than the length of a column form into which they are inserted. In use, the elongated insert segments 422*a*, 422*b* are inserted into one open end of a column form. In some embodiments, the insert segments include a top plate 428 extending radially away from a top end of each wall segment and at least to a perimeter of a top end of the column form. In some embodiments, an outer perimeter of the top plate 428 is shaped to conform to the top edge of the column form as shown in FIG. 22B. The top plate 428 prevents material poured into the open end from filling any voids between the thin-walled insert segments 422 and the interior of the column form. Thus, the poured material is directed into an interior lumen formed by the wall segments 424 of the thin-walled column forming insert assembly 420. In some embodiments, one or more retaining clips 434', 434" (generally 434) are provided to align the top of the elongated insert segments 422 with a top end of the column form 432. In the exemplary embodiment, the retaining clips 434 are angled having a vertical segment aligned with an exterior surface of the column form 432. In some embodiments, referring again to FIG. 22A, the insert segments 422 include a bottom plate 430 extending radially away from a bottom end of each wall segment and at least to a perimeter of a top end of the column form.

Advantageously, the thin-walled elongated insert segments 422 are stackable in a compressed configuration for stowage and transportation. The insert segments 422 can be formed from similar materials and using similar processes as described above in reference to the multi section column-forming assemblies. In one particular embodiment, the insert segments are formed from a plastic material using an injection molding process. The insert segments 422 can be formed in substantially any desired shape and configured to fit any sized and shaped column form. Alternatively or in addition, one or more of the insert segments 422 includes a negative pattern facing the poured material to form the desired pattern in the poured material when cured.

Figure 23B:
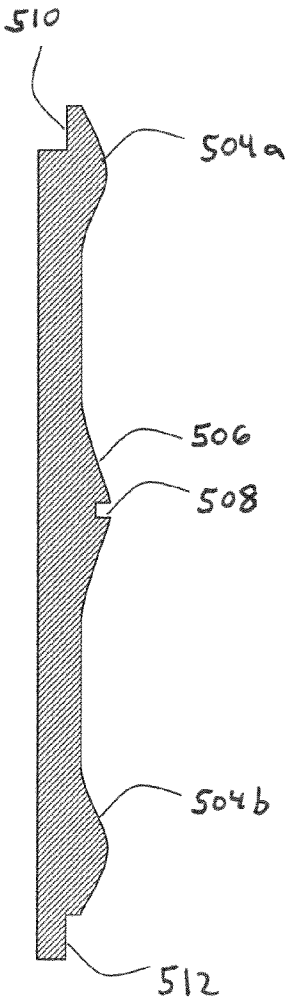
FIG. 23B shows a cross sectional view of one of the form sections of FIG. 23A.
Figure 23A:
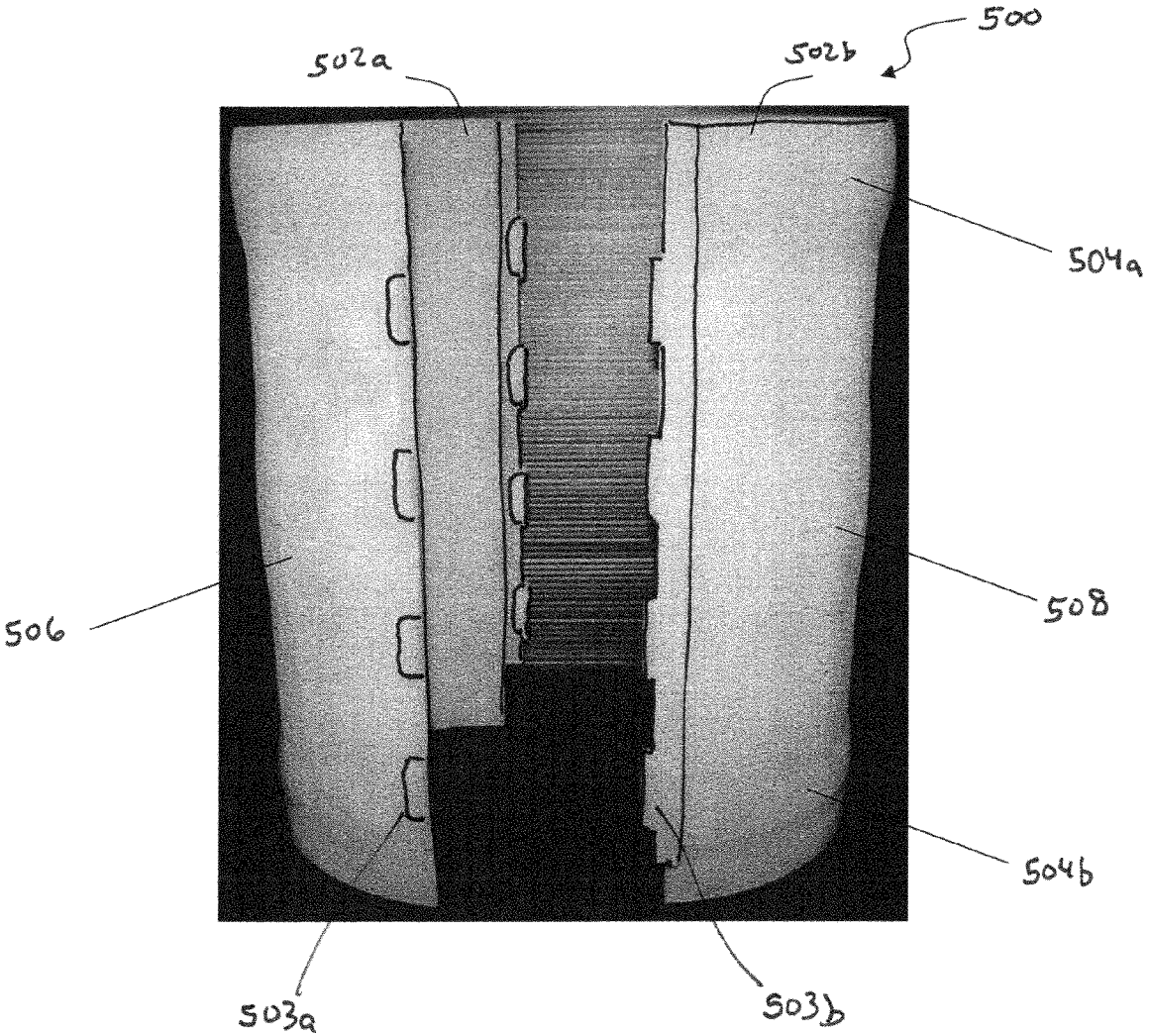
FIG. 23A shows an exploded top perspective view of an alternative embodiment of a concrete column forming assembly constructed in according to principles of the present invention.

An alternative embodiment of a column-forming assembly is shown in FIG. 23A. The column-forming assembly 500 includes at least two sections 502*a*, 502*b*, each including interlocking fastening means 503*a*, 503*b* (generally 503) to interlock the sections together to create a hollow form into which a pourable and settable material, such as concrete, can be poured. The fastening means can be any suitable fastening means, such as any of the means described herein. Preferably the fastening means 503 are strong enough to hold the forms together in sealable engagement (preventing a blowout) when filled with a settable material. In some embodiments, each form section 502 includes one or more ribs. For the exemplary embodiment, each 24 inch section 502 includes three ribs: a top rib 504*a*; a central rib 506 and a bottom rib 504*b*. The ribs 504*a*, 504*c*, 506 can be formed by providing a thicker wall in the area of the rib. As shown, the ribs can be formed to extend over a selectable axial length of the section 502. The longer the rib 504*a*, 504*b*, 506, the greater the support provided for resisting blowout when filled with a settable material.

A cross sectional view of one of the form sections 502 is shown in FIG. 23B. As shown, the ribs can be formed to have a smooth, tapered profile along the length of the axis. One or more of the ribs 506 can include a circumferential notch 508 or other type of marking (e.g., ink or paint) that can be used as a guide for cutting the section 502 to a shorter length. Also shown are an end slot 510 and tongue 512 that can be used for longitudinal stacking of similar segments.

While this invention has been particularly shown and described with references to preferred embodiments thereof, it should be apparent that unique operational features have been described. Although particular embodiments have been disclosed herein in detail, this has been done by way of example for purposes of illustration only, and is not intended to be limiting with respect to the scope of the appended claims which follow. In particular, it is contemplated by the inventors that various substitutions, alterations, and modifications may be made to the invention without departing from the spirit and scope of the invention encompassed in the appended claims. For instance, the shape and size of the housing, the choice of materials, the configuration of fastening members employed is believed to be matter of routine for a person of ordinary skill in the art with knowledge of the embodiments described herein.

What is claimed is:

1. A concrete column-forming tube kit comprising:

a plurality of wall sections, wherein each wall section extends along a longitudinal axis, and includes:

i. an interior surface, ii. a top edge, iii. a bottom edge, iv. opposite side edges; and v. multiple interconnecting flanges extending radially outward from each of the opposite side edges, the multiple interconnecting flanges being spaced apart with respect to each other in the direction of the longitudinal axis, along each of the opposite side edges, wherein some of the multiple interconnecting flanges are adapted for sliding in the direction of the longitudinal axis to effect sliding interlocking engagement with respective others of the multiple interconnecting flanges of an adjacent one of the plurality of wall sections, at least some of the multiple interconnecting flanges comprising a hooked interconnecting element adapted for sliding in the direction of the longitudinal axis to effect sliding interlocking engagement with a complementary hooked interconnecting element of an adjacent one of the plurality of wall sections, wherein each of the hooked interconnecting elements of an interconnecting flange defines an interior region (i) extending in the direction of the longitudinal axis, (ii) having a uniform cross-section transverse to the longitudinal axis extending along the full axial length of the interconnecting flange, and (iii) adapted to receive a longitudinally extending portion of a hooked interconnecting element of one of the complementary interconnecting flanges of an adjacent one of the plurality of wall sections, wherein the plurality of wall sections are joinable together along adjacent side edges in interlocking engagement to form a closed side wall extending vertically between two opposing ends of a column-forming tube, the closed side wall defining a central lumen.

2. The concrete column-forming tube kit of claim 1, wherein the multiple interconnecting flanges are integrally formed together with each wall section of the plurality of wall sections.

3. The concrete column-forming tube kit of claim 1, wherein at least one of the hooked interconnecting elements comprises a male interlocking member, and at least one of the complementary hooked interconnecting elements comprises a female interlocking member, the male interlocking member at least partially insertable within the female interlocking member to join together adjacent wall sections.

4. The concrete column-forming tube kit of claim 3, wherein at least one of the male interlocking member and the female interlocking member is elongated, extending along at least a portion of a respective one of the opposite side edges.

5. The concrete column-forming tube kit of claim 1, wherein at least one of the plurality of wall sections is formed from a moldable material.

6. The concrete column-forming tube kit of claim 5, wherein the moldable material is injection-molded plastic.

7. The concrete column-forming tube kit of claim 1, wherein at least one of the plurality of wall sections is formed from a biodegradable material.

8. The concrete column-forming tube kit of claim 1, wherein at least one of the plurality of wall sections comprises a rabbet extending between opposite side edges along the interior surface of one of the top and bottom edges adapted to receive a flange extending longitudinally from a complementary one of the top and bottom edges of a longitudinally adjacent one of the plurality of wall sections, the rabbet and flange joinable in an overlapping arrangement.

9. The concrete column-forming tube kit of claim 1, wherein the interior surface of at least one of the plurality of wall sections is concave.

10. The concrete column-forming tube kit of claim 1, wherein the concave interior surface defines a longitudinal section of a cylinder.

11. The concrete column-forming tube kit of claim 1, wherein a first length between top and bottom edges of at least one of the plurality of wall sections is different than a second length between top and bottom edges of at least one other of the plurality of wall sections.

12. The concrete column-forming tube kit of claim 1, wherein each wall section of the plurality of wall sections comprises an exterior surface adapted to abut the interior surface of an adjacent unjoined wall section in a nested configuration.

13. The concrete column-forming tube kit of claim 1, wherein the each wall section of the plurality of wall sections is thin-walled, including a plurality of spaced-apart stiffening flanges, each extending radially outward from an external surface.

14. The concrete column-forming tube kit of claim 1, wherein the interior surface of each wall section of the plurality of wall sections is substantially smooth.

15. The concrete column-forming tube kit of claim 1, further comprising a column-end forming extension having an opening at one end, the column-end forming extension adapted for axial attachment to at least one of the top and bottom ends of a column-forming tube such that the opening of the column-end forming extension is in fluid communication with the central lumen of the column-forming tube.

* * * * *